US009269359B2

(12) United States Patent
Ojanperä

(10) Patent No.: US 9,269,359 B2
(45) Date of Patent: Feb. 23, 2016

(54) CODING OF MULTI-CHANNEL SIGNALS

(75) Inventor: Juha Ojanperä, Nokia (FI)

(73) Assignee: Nokia Technologies Oy, Espoo (FI)

( * ) Notice: Subject to any disclaimer, the term of this patent is extended or adjusted under 35 U.S.C. 154(b) by 855 days.

(21) Appl. No.: 13/502,367

(22) PCT Filed: Oct. 30, 2009

(86) PCT No.: PCT/EP2009/064380
§ 371 (c)(1),
(2), (4) Date: Apr. 16, 2012

(87) PCT Pub. No.: WO2011/050853
PCT Pub. Date: May 5, 2011

(65) Prior Publication Data
US 2012/0207313 A1 Aug. 16, 2012

(51) Int. Cl.
*G10L 25/00* (2013.01)
*G10L 19/008* (2013.01)

(52) U.S. Cl.
CPC ..... *G10L 19/008* (2013.01)

(58) Field of Classification Search
CPC ..... G10L 19/008
USPC ..... 704/501
See application file for complete search history.

(56) References Cited

U.S. PATENT DOCUMENTS

2008/0175394 A1 7/2008 Goodwin

OTHER PUBLICATIONS

International Search Report and Written Opinion for corresponding patent Cooperation Treaty Application No. PCT/EP2009/064380, mailed May 20, 2010. (15 pages).
International Preliminary Report of Patentability for corresponding patent Cooperation Treaty Application No. PCT/EP2009/064380, mailed May 1, 2012. (7 pages).
Office Action for corresponding Chinese Patent Application No. 200980162219.9, dated Mar. 29, 2013.
Goodwin M.M. et al. "Primary-Ambient Signal Decomposition and Vector-Based Localization for Spatial Audio Coding and Enhancement", 2007 IEEE International Conference on Acoustics Speech and Signal Processing Apr. 15-20, 2007, Honolulu, HI, USA, IEEE, pp. 9-12.
Goodwin Michael M. et al. "A Frequency-domain Framework for Spatial Audio Coding Based on Universal Spatial Cues", Audio Engineering Society Convention Paper, [12056], New York, NY; US, vol. 120th, No. 6751, May 20, 2006 pp. 1-12, XP 002477914.
(Continued)

*Primary Examiner* — Duc Nguyen
*Assistant Examiner* — Kile Blair
(74) *Attorney, Agent, or Firm* — Alston & Bird LLP

(57) ABSTRACT

A system comprises: first and second base stations; and a plurality of relay nodes, each of said relay nodes connected to the first base station, each of said relay nodes being connected to at least one other relay node, whereby at least one relay node is configured to at least one of receive and send information for another of said relays nodes; wherein when at least one of the plurality of relay nodes is handed over to a second base station the at least one relay node is configured to receive and/or send information via another of the relay nodes connected to the first base station.

12 Claims, 8 Drawing Sheets

(56) References Cited

OTHER PUBLICATIONS

Briand, M. et al. Audio Engineering Society (AES), *Parametric Representation of Multichannel Audio Based on Principal Component Analysis*, Convention Paper 6813, (May 20, 2006-May 23, 2006) 1-14.

Henning, L. et al. Audio Engineering Society (AES), *Perceptual Importance of Karhunen-Lòeve Transformed Multichannel Audio Signals*, Convention Paper 6964, (Oct. 5, 2006-Oct. 8, 2006) 1-29.

CODING OF MULTI-CHANNEL SIGNALS

RELATED APPLICATION

This application was originally filed as PCT Application No. PCT/EP2009/064380 filed Oct. 30, 2009.

FIELD OF THE DISCLOSURE

This invention relates to the field of coding of multi-channel signals.

BACKGROUND

A multi-channel audio signal can be captured using multiple microphones within common acoustic space or created in a synthetical manner by combining a number of possibly unrelated audio signals. A multi-channel audio signal may comprise any number of channels, common channel configurations are for example "traditional two-channel stereo", 5.1 or 7.2 channel configurations commonly used in consumer electronics. Typically, coding of multi-channel audio signals at high-quality requires high bit-rate, which may not be feasible in all applications and operational scenarios.

An emerging new type of use case for audio capture and further processing is multiview audio, which is a concept that provides different aural views to an audio scene, from which (e.g.) a user can select the one he/she prefers.

In principle, "traditional" multi-channel audio can be seen as a subset of multiview audio, implying that generic multi-channel audio coding techniques may be applied to multiview audio to introduce relatively low bit-rates.

SUMMARY OF SOME EMBODIMENTS OF THE INVENTION

A first method is described, which comprises performing a concatenated component analysis based on a time-frequency representation of a multi-channel signal for determining a down-sampled representation of the multi-channel signal, wherein said concatenated component analysis comprises applying a first component analysis for determining a first set of signal components representing the multi-channel signal, and applying a second component analysis based on the first set of signal components for determining a second set of signal components representing the multi-channel signal.

Moreover, a first apparatus is described, which comprises means for performing a concatenated component analysis based on a time-frequency representation of a multi-channel signal for determining a down-sampled representation of the multi-channel signal, wherein said concatenated component analysis is performed by means for applying a first component analysis for determining a first set of signal components representing the multi-channel signal and by means for applying a second component analysis based on the first set of signal components for determining a second set of signal components representing the multi-channel signal.

The means of this apparatus can be implemented in hardware and/or software. They may comprise for instance a processor for executing computer program code for realizing the required functions, a memory storing the program code, or both. Alternatively, they could comprise for instance a circuit that is designed to realize the required functions, for instance implemented in a chipset or a chip, like an integrated circuit.

Moreover, a second apparatus is described, which comprises at least one processor and at least one memory including computer program code, the at least one memory and the computer program code, with the at least one processor, configured to cause the apparatus at least to perform the actions of the presented first method.

Moreover, a computer readable storage medium is described, in which computer program code is stored. The computer program code causes an apparatus to realize the actions of the presented first method when executed by a processor.

The computer readable storage medium could be for example a disk or a memory or the like. As an example, the memory may represent a memory card such as SD and micro SD cards or any other well-suited memory cards or memory sticks. The computer program code could be stored in the computer readable storage medium in the form of instructions encoding the computer-readable storage medium. The computer readable storage medium may be intended for taking part in the operation of a device, like an internal or external hard disk of a computer, or be intended for distribution of the program code, like an optical disc.

A second method is described, which comprises performing a concatenated reconstruction of a multi-channel signal based on a down-sampled representation of the multi-channel signal, wherein said concatenated reconstruction comprises applying a first component synthesis for determining a first set of reconstructed signal components representing the multi-channel signal; and applying a second component synthesis based on the first set of reconstructed signal components for determining reconstructed representation of the multi-channel signal.

Moreover, a third apparatus is described, which comprises means for performing a concatenated reconstruction of a multi-channel signal based on a down-sampled representation of the multi-channel signal, wherein said concatenated reconstruction is performed by means for applying a first component synthesis for determining a first set of reconstructed signal components representing the multi-channel signal and means for applying a second component synthesis based on the first set of reconstructed signal components for determining reconstructed representation of the multi-channel signal.

The means of this third apparatus can be implemented in hardware and/or software. They may comprise for instance a processor for executing computer program code for realizing the required functions, a memory storing the program code, or both. Alternatively, they could comprise for instance a circuit that is designed to realize the required functions, for instance implemented in a chipset or a chip, like an integrated circuit.

Moreover, a fourth apparatus is described, which comprises at least one processor and at least one memory including computer program code, the at least one memory and the computer program code, with the at least one processor, configured to cause the apparatus at least to perform the actions of the presented second method.

Moreover, a computer readable storage medium is described, in which computer program code is stored. The computer program code causes an apparatus to realize the actions of the presented second method when executed by a processor.

Moreover, a system is described, comprising an apparatus according to one of the first and second apparatus and comprising a further apparatus according to one of the third and fourth apparatus.

The multi-channel signal may comprise at least two channels, wherein each of the at least two channels is associated with a signal.

For instance, the multi-channel signal may represent a "traditional two-channel stereo" signal, or a 5.1 or 7.2 channel configuration or any other multi-channel configuration. Furthermore, as an example, the multi-channel signal may represent a multi-view signal, wherein different channels of the multi-channel signal are associated with different aural views to an audio scene. Thus, each of said different channels is associated with a signal being associated with the respective aural view of the different aural views.

As an example, the multi-channel signal may represent a mixture of a multi-view signal and at least one further signal. Furthermore, the multi-channel signal may represent a multi-channel audio signal or a multi-channel video signal or any other kind of multi-channel signal.

For instance, the multi-channel signal may represent the signal of closely spaced microphones all pointing toward a different angle relative to the forward axis which may be used to record an audio scene in accordance with a multi-view audio system.

For instance, the multi-channel signal may be in the time-frequency domain. In this case, the multi-channel signal may be directly processed by the first apparatus.

As another example, the first or second apparatus may comprise a converter configured to transform the multi-channel signal into the time-frequency representation.

The first component analysis may represent an analysis procedure which is configured to perform a first decorrelation of the time-frequency representation of the multi-channel signal. For instance, this first decorrelation may be directed to each of at least one channel of the at least two channels of the multi-channel signal, i.e. the first decorrelation may be performed to decorrelate each channel of at least one channel of the at least two channels separately, thereby representing an intra-channel decorrelation. Furthermore, as an example, this first decorrelation may perform a decorrelation between at least two channels of the at least two channels of the multi-channel signal, thereby representing an inter-channel decorrelation.

Furthermore, as an example, the first component analysis may determine a set of first analysis components, wherein this set of first analysis components is configured to be used in combination with the first set of signal components for reconstruction of the multi-channel signal. For instance, the multi-channel signal may be reconstructed by a linear combination of the first analysis components and the first set of signal components.

The first set of signal components represents the multi-channel signal after this first component analysis has been performed. Thus the multi-channel signal (or an approximation of the multi-channel signal) may be reconstructed by means of a corresponding component synthesis applied to the first set of signal components, the first component synthesis representing the inverse operation of the first component analysis.

For instance, the first component analysis may by performed by means of a principal component analysis (PCA) or an independent component analysis (ICA), but any other well-suited component analysis may also be used for carrying out the first component analysis.

Due to the first component analysis the output data rate of the determined first set of signal components may be reduced compared to the input data rate of the time-frequency domain representation 1 of the multi-channel signal.

The second component analysis may be different compared to first component analysis. For instance, the first component analysis may perform a first decorrelation of the time-frequency representation of the multi-channel signal, as mentioned above, and the second component analysis may perform a second decorrelation of the multi-channel signal based on the first set of signal components, wherein the first decorrelation differs from the second decorrelation. As an example, the second decorrelation may be one of the above-mentioned inter-channel decorrelation and intra-channel decorrelation and the first decorrelation may be remaining inter-channel or intra-channel decorrelation.

Furthermore, as an example, the second component analysis may determine a set of second analysis components, wherein this set of second analysis components is configured to be used in combination with the second set of signal components for reconstruction of the first set of signal components. For instance, the first set of signal components may be reconstructed by a linear combination of the second analysis components and the second set of signal components.

The second set of signal components represents the multi-channel signal after this second component analysis has been performed. Thus the first set of signal component (or an approximation of the first set of signal components) may be reconstructed by means of a corresponding component synthesis applied to the second set of signal components the second component synthesis representing the inverse operation of the second component analysis.

For instance, the second component analysis may by performed by means of a principal component analysis (PCA) or an independent component analysis (ICA), but any other well-suited component analysis may also be used for carrying out the second component analysis.

Thus, due to the concatenated component analysis different statistical properties of the multi-channel signal may be used for a two-stage component analysis in order to reduce the data rate of the multi-channel signal, wherein the first component analysis is directed to exploit one of the different statistical properties and the second component analysis is directed to exploit another of the different statistical properties.

For instance, the multi-channel signal is associated with at least two channels. Furthermore, as an example, the first component analysis comprises for each channel of at least one channel of the at least two channels applying an intra-channel component analysis for determining a subset of signal components representing the signal of the respective channel.

The down-sampled representation of the multi-channel signal may comprise the second set of signal components. Due to the two-stage decomposition of the multi-channel signal the data rate of the down-sampled representation of the multi-channel signal is reduced compared to the inputted multi-channel signal.

The third or fourth apparatus may be configured to have access to a signal which may represent or comprise the down-sampled representation of the multi-channel signal. This access to the signal may be represented any well-suited access, i.e. this signal may represent any kind of accessed signal representing or comprising the down-sampled representation of the multi-channel signal. As an example, the signal may be stored in a kind of memory, or it may be transmitted from another functional entity to the third or fourth apparatus. For instance, the third or fourth apparatus may be configured to receive the signal. As an example, the third or fourth apparatus may be configured to receive the signal after being transmitted over a channel.

The first component synthesis may represent an inverse operation of the second component analysis. Thus the first set of signal components (or an approximation of the first set of signal components) may be reconstructed by means of the first component synthesis applied to the second set of signal components, which are included in the down-sampled representation of the multi-channel signal of the accessed signal.

Furthermore, as an example, the first component synthesis may be performed based on the set of second analysis components which may be used in combination with the accessed second set of signal components.

The second component synthesis may represent an inverse operation of the first component analysis. Thus, for instance, the time-frequency domain representation of the multi-channel signal may be reconstructed by means of the second component synthesiser as reconstructed representation of the multi-channel signal based on the first set of reconstructed signal components.

Furthermore, as an example, the second component synthesis may be performed based on the set of first analysis components which may be used in combination with the first set of reconstructed signal components for reconstruction of the multi-channel signal.

For instance, the third or fourth apparatus may be used in a receiver in order to reconstruct the multi-channel signal.

According to a further aspect, the multi-channel signal is associated with at least two channels, the first component analysis comprises for each channel of at least one channel of the at least two channels applying an intra-channel component analysis for determining a subset of signal components of said first set of signal components representing the signal of the respective channel, and the second component analysis represents an inter-channel component analysis of at least two channels of the at least two channels associated with the multi-channel signal.

For instance, one of these at least two audio channels may be selected and an intra-channel component analysis may be applied for determining a subset of signal components representing the signal of the respective channel. The intra-channel component analysis may be carried out as explained above, for example based on PCA or any other well-suited component analysis. Thus, a decorrelation of the signal of the respective channel may be performed.

Furthermore, as an example, the intra-channel component analysis may determine a subset of first analysis components, wherein this subset of first analysis components is configured to be used in combination with the subset of signal components for reconstruction of the signal of the respective channel of the multi-channel signal, e.g. by means of a linear combination. The set of first analysis components may comprise this subset of first analysis components.

Then it may be checked whether a component analysis is to be performed for a next channel of the at least two channels. If there is a next channel for component analysis the method may proceed with selecting this channel and applying the intra-channel component analysis for determining a subset of signal components representing the signal of the selected channel.

The signal components of each determined subset of signal components being associated with the respective channel are signal components of the first set of signal components. Accordingly, the first set of components comprises the at least one subset of signal components determined by the respective intra-channel component analysis of the respective channel.

For instance, this may be performed for each of the at least one channel of the at least two channels of the multi-channel signal in order to determine at least one subset of signal components of the first set of signal components.

Furthermore, as an example, the time-frequency representation may comprise at least two sets of time-frequency representatives, wherein each set of the at least two sets of time-frequency representatives is associated with one channel of the at least two channels of the multi-channel signal.

Furthermore, for instance, in case the intra-channel component analysis is not applied for at least one channel of the at least two channels of the multi-channel signal, the signal of this at least one channel may be represented by the respective time-frequency representatives. For instance, the set of first signal components may comprise at least one subset of signal components being associated with said at least one channel for which no intra-channel component analysis has been applied, wherein each of this at least one subset of signal components comprises the respective set of time-frequency representatives being associated with the respective channel.

Accordingly, as an example, the intra-channel component analysis may be performed based on the set of time-frequency representatives of the at least two sets of time-frequency representatives associated with the respective channel.

For instance, the inter-channel component analysis may be performed on the basis of the determined at least one subset of signal components of the first set of signal components which has been determined by the first component analysis as mentioned above.

As an example, the inter-channel component analysis may be applied for at least two channels of the at least two channels of the multi-channel signal in order to determine signal components of the second set of signal components representing the signals of these at least two channels of the at least two channels of the multi-channel signal. This determining may be performed on basis of the respective subset of signal components of the first set of signal components being associated with the at least two channels of the at least two channels of the multi-channel signal.

Furthermore, as another example, in case the inter-channel component analysis is not applied for at least one channel of the at least two channels of the multi-channel signal, the signal of this at least one channel may be represented by the respective signal components of the first set of signal components.

The inter-channel component analysis may be carried out as explained above, for example based on PCA or any other well-suited component analysis. Thus, a decorrelation of the at least two channels of the at least two channels of the multi-channel signal may be performed.

Furthermore, as an example, the inter-channel component analysis may determine analysis components of the set of second analysis components, wherein these determined analysis components are configured to be used in combination with the second set of signal components for reconstruction of the signal of the at least one channel of the multi-channel signal, e.g. by means of a linear combination.

According to a further aspect, the first component synthesis represents an inter-channel synthesis of at least two channels of the at least two channels associated with the multi-channel signal, and the second component synthesis comprises for each channel of at least one channel of the at least two channels applying an intra-channel component synthesis for determining a reconstructed signal of the respective channel.

This reconstructed signal of the respective channel may represent the above-mentioned set of time-frequency representatives being associated with the respective channel.

According to a further aspect, each channel of the at least one channel of the at least two channels is associated with a frequency band, and the intra-channel component analysis for a respective channel comprises applying a component analysis for each subband of at least one subband of the frequency band of the respective channel for determining a subsubset of signal components associated with the respective subband of the respective channel for each subband of the at least one subband, a subsubset of signal components representing signal components of the first set of signal components representing the signal in the respective subband of the respective channel of the multi-channel signal.

Each channel of the at least one channel of the at least two channels is associated with a frequency band. The width of the frequency band of one channel may depend on the signal associated with the respective channel and can either be fixed or variable.

Furthermore, the frequency band of one channel of the at least one channel is associated with at least one subband of the frequency band of the respective channel.

A component analysis is applied for each subband of at least one subband of the frequency band of the respective channel for determining a subsubset of signal components for each subband of the at least one subband of the respective channel. A subsubset of signal components represents signal components of the first set of signal components representing the signal in the respective subband of the respective channel of the multi-channel signal.

Furthermore, as an example, the component analysis associated with a subband of the at least one subband of the frequency band of the respective channel may determine a subsubset of first analysis components, wherein this subsubset of first analysis components is configured to be used in combination with the respective subsubset of signal components for reconstruction of the signal of respective subband of the respective channel of the multi-channel signal, e.g. by means of a linear combination. The set of first analysis components may comprise this subsubset of first analysis components.

This determining may be performed based on the time-frequency representatives of the set of time-frequency representatives of the respective channel and being associated with the respective subband of the respective channel. For instance, each set of time-frequency representatives associated with one channel may comprise at least one subset of time-frequency representatives, wherein each subset of time-frequency representatives may be associated with one subband of the respective channel and may comprise time-frequency representatives representing the signal in the respective subband of the respective channel.

For instance, the above-mentioned subset of signal components being associated with the respective channel may comprise the at least one subsubset of signal components determined by means of a component analysis for one channel. Accordingly, each subsubset of signal components comprises signal components representing the signal in the subband of the respective channel determined by the applied component analysis.

Thus, for example, a plurality of intra-channel component analysis may be performed for different subbands of a frequency band of a respective channel. For instance, a decorrelation of signals in different subbands of a respective channel may be performed, which may enhance the quality of decorrelation.

According to a further aspect, the intra-channel component synthesis for a respective channel comprises applying a component synthesis for each subband of at least one subband of the frequency band of the respective channel for determining a subsignal of reconstructed signal components associated with the respective subband of the respective channel for each subband of the at least one subband.

For instance, this reconstructed subsignal may represent reconstructed time-frequency representatives representing the signal in the respective subband of the respective channel.

Furthermore, as an example, the intra-channel first component synthesis for a respective channel comprises applying a component synthesis may be performed based on a respective subset of first analysis components.

According to a further aspect, the inter-channel component analysis comprises applying at least one component analysis for determining at least one subset of signal components of the second set of signal components, wherein each of the at least one component analysis is associated with at least two channels of the at least two channels of the multi-channel signal and with a subband of a frequency band associated with the respective at least two channels of the at least two channels, each determined subset of signal components representing signal components of the second set of signal components representing the signals of the respective at least two channels of the multi-channel signal in the respective subband.

Thus, each determined subset of signal components may comprise signal components of the second set of signal components representing the signals of the respective at least two channels of the multi-channel signal in the respective subband.

The determining is based on the first set of signal components. Accordingly, signal components of the first set of signal components representing the signals of the respective at least two channels in the respective subband may be used as basis for the component analysis of the inter-channel component analysis.

For instance, under the assumption of the example notation regarding the subsubset of signal components of the first set of signal components, one component analysis of the at least one component analysis of the inter-channel component analysis may be applied based on the respective at least two subsubsets of signal components of the first set of signal components, wherein a subsubset of signal components of the at least two subsubsets of signal components is associated with the respective subband of the respective channel of the respective at least two channels.

As an example, the inter-channel component analysis may comprise a component analysis for each subband of a frequency band associated with the at least two channels.

Furthermore, as an example, a component analysis of the at least one component analysis of the inter-channel component analysis may determine a subset of second analysis components of the set of second analysis components, wherein the subset of second analysis components is configured to be used in combination with the respective subset of second set of signal components for reconstruction of the respective at least two subsubsets of signal components of the first set of signal components.

According to a further aspect, the inter-channel component synthesis comprises applying at least one component synthesis for determining at least one subset of reconstructed signal components of the first set of reconstructed signal components, wherein each of the at least one component synthesis is associated with at least two channels of the at least two channels of the multi-channel signal and with a subband of a frequency band associated with the respective at least two channels of the at least two channels, each determined subset of reconstructed signal components representing reconstructed signal components of the first set of reconstructed signal components representing the signals of the respective at least two channels of the multi-channel signal in the respective subband.

For instance, each determined subset of reconstructed signal components may represent a reconstructed subsubset of signal components associated with the respective subband of the respective channel of the respective at least two channels.

Furthermore, as an example, the first component synthesis may be performed based on the set of second analysis components, as explained above.

According to a further aspect, converting a time-domain representation of the multichannel signal to said time-frequency representation of the multi-channel signal is performed, the time-frequency representation comprising at least two sets of time-frequency representatives, each set of the at least two sets of time-frequency representatives being associated with one channel of the at least two channels.

For instance, the multi-channel signal may represent this time-domain representation of the multi-channel signal.

The time-frequency representation comprises at least two sets of time-frequency representatives, each set of the at least two sets of time-frequency representatives being associated with one channel of the at least two channels of the multi-channel signal. Furthermore, each set of the at least two sets of time-frequency representatives may comprise at least one subset of time-frequency representatives, wherein each time-frequency representative of a subset of the at least one subset is associated with a frequency component of the frequency band of the respective channel and with different point in times. For instance, the time-frequency representatives of a subset of the at least one subset are associated with the respective frequency component and a time frame.

For instance, the frequency component of the frequency band of the respective channel may correspond to the above-mentioned subband of the frequency band of the respective channel, but, as another example providing a higher resolution in frequency, one subband of the frequency band of the respective channel my be associated with at least two frequency components.

For instance, this converting may be based on a Fourier Transformation, e.g. implemented by means of a Fast Fourier Transformation (FFT) or a Discrete Fourier Transformation (DFT) or any other well-suited Fourier Transformation, and/or by means of a Discrete Cosine Transformation (DCT) and/or by means of any other suited transformation.

Accordingly, the time-frequency representation of the multi-channel signal may be used for one or more of the above-mentioned component analysis.

As an example, applying a component analysis for a respective subband of a respective channel for determining a subsubset of signal components of the first set of signal components may be performed based on the set of time-frequency representatives associated with this respective channel and with at least one subset of time-frequency representatives of this set of time-frequency representatives, the at least one subset of time-frequency representatives being associated with the respective subband. I.e., the at least one frequency component associated with the at least one subset of time-frequency representatives are associated with the respective subband of the respective channel.

Furthermore, with respect to the second method or to the third or fourth apparatus, one of these apparatuses may comprise a converter representing an inverse converter with respect to above mentioned conversion.

According to a further aspect, said converting comprises for each of the at least two channels transforming the time-domain representation of the respective channel of the time-domain representation into a frequency domain representation; and performing a two-dimensional discrete cosine transformation based on the frequency domain representation associated with the respective channel in order to determine the set of time-frequency representatives associated with the respective channel.

For instance, the time-domain representation of a channel m of the at least two channels may be represented by $x_m(k)$. A frame 1 of time-domain representations $x_m(t)$ may converted by a first transformer to a respective frequency domain representation $X_m[k,l]$, where k is the frequency component index (e.g. k may represent a frequency bin index) and wherein TF may represent a corresponding time-to-frequency operator:

$$X_m[k,l]=\mathrm{TF}(x_{m,l}) \tag{1}$$

For instance, this may be performed for each of the channels.

As an example, a Modified Discrete Cosine Transformation may be used for the first transformer, as exemplarily explained in the sequel:

For instance and as non-limiting example, the TF operator may be applied to each signal segment according to $$X_m[k,l]=\mathrm{TF}(x_{m,l,T}) \tag{2}$$

where m is the channel index, k is the frequency bin index, 1 is time frame index, T is the hop size between successive time frames, and TF the time-to-frequency operator. A MDCT may be used as the TF operator as follows $$TF(x_{m,l,T}) = 2\cdot\sum_{n=0}^{N-1} x_{in}(n)\cdot\cos\left(\frac{2\cdot\pi}{N}\cdot\left(n+\frac{N}{4}+0.5\right)\cdot(k+0.5)\right), \quad 0\le k<\frac{N}{2}-1 \tag{3}$$

$$x_{in}(n) = w(n)\cdot x_m(n+l\cdot T)$$

where w(n) is the N-point analysis window such as sinusoidal or Kaiser-Bessel Derived (KBD) window. In MDCT, the hop size is T=N/2.

For instance, assuming that the at least two channels are M channels, the frequency domain representation of the multi-channel signal is represented by $X_m[k,l]$ with $0<m\le M$.

A second transformer may be configured, for each channel of the at least two channels, to perform a two-dimensional discrete cosine transformation (2D-DCT) based on the frequency domain representation associated with the respective channel in order to determine the set of time-frequency representatives associated with the respective channel.

For instance, the set-of time-frequency representative of channel m may be represented by matrix $Y_m[k,t]$, where t is the time-index. Accordingly, k is the index of the respective frequency component and all representatives of $Y_m[k,t]$ with a fixed k and a fixed m represent the above-mentioned subset of the time-frequency representatives being associated with channel m and frequency component k.

As an example, the operation of the second transformer may be applied to the frequency domain representation based on a 2D-DCT as follows:

$$Y_m[k,t] = \left(\frac{2}{A}\right)^{\frac{1}{2}}\cdot\left(\frac{2}{B}\right)^{\frac{1}{2}}\cdot \sum_{i=0}^{A-1}\sum_{j=0}^{B-1}\left(C(i)\cdot C(j)\cdot F[i,j]\cdot\cos\left[\frac{\pi\cdot k}{2\cdot A}\cdot(2\cdot i+1)\right]\cdot\cos\left[\frac{\pi\cdot t}{2\cdot B}\cdot(2\cdot j+1)\right]\right)$$

$$F = X_m[k,u],\ \mathrm{t_start}\le u<\mathrm{t_end}$$

$$\mathrm{t_start} = grpIdx\cdot\mathrm{TF_size}$$

-continued $$t_end = t_start + TF_size$$

$$grpIdx = 0, 1, 2, 3, \ldots$$

$$A = N/2,\ B = t_end - t_start,\ C(i) = \begin{cases} \frac{1}{\sqrt{2}}, & i == 0 \\ 1, & \text{otherwise} \end{cases}$$

where TF_size is the size of the 2D time-frequency plane. The size of matrix $Y_m$ may therefore be TF_size×A.

According to one aspect, the first method comprises extracting from each of at least one set of signal components of the first set of signal components a separate subset of relevant signal components, wherein each subset of relevant signal components represents a part of the multi-channel signal associated with the respective set of signal components of the first set of signal components in accordance with a first accuracy criteria; and extracting from each of at least one set of signal components of the second set of signal components a separate subset of relevant signal components, wherein each subset of relevant signal components represents a part of the multi-channel signal associated with the respective set of signal components of the second set of signal components in accordance with a second accuracy criteria.

Each of the at least one set of signal components may be associated with one component analysis of the first component analysis.

For instance, one set of the at least one set of signal components may represent a subset of signal components of the first set of signal components determined by means of the intra-channel component analysis. In this example case, the subset of relevant signal components may represent the signal (or an approximation of this signal) of the respective channel of the multi-channel signal.

Or, as another example, one set of the at least one set of signal components may represent a subsubset of signal components of the first set of signal components determined by means of the component analysis for a respective subband of a respective channel. In this example case, the subset of relevant signal components may represent the signal (or an approximation of this signal) of the respective subband of the respective channel of the multi-channel signal.

The first accuracy criteria may represent any well-suited criteria configured to determine the quality of the part of the multi-channel signal reconstructed by means of the respective set of relevant signal components.

Furthermore, for instance, first extraction information may be provided indicative which signal components of a set of the at least one set of signal components have been extracted to the respective subset of relevant signal components.

Further, as an example, this first extraction information may be used in order to reconstruct the first signal components before the second component synthesis is performed.

Thus, for instance, only those signal components of a set of the at least one set of signal components are selected which are sufficient to represent the respective part of the multi-channel signal at desired accuracy, whereas the remaining signal components may be discarded. These selected signal components may define the corresponding subset of relevant signal components. For instance, the first extraction information may comprise the number of selected components of a set of the at least one set of signal components.

According to an aspect of the invention, said extracting comprises at least one of (a) determining a measure of relevance for each signal component of each of the at least one set of signal components of the first set of signal components, the measure of relevance indicating the relevance of the associated signal component with respect to the part of multi-channel signal associated with the respective set of signal components of the first set of signal components; and (b) determining a measure of relevance for each signal component of each of the at least one set of signal components of the first set of signal components, the measure of relevance indicating the relevance of the associated signal component with respect to the part of multi-channel signal associated with the respective set of signal components of the first set of signal components.

For instance, the measure of relevance associated with a signal component may represent a variance. For instance, this variance may be computed by means of the respective component analysis when determining the first set of signal components, or when determining a subset of signal components of the first set of signal components, or when determining a subsubset of signal components of the first set of signal components.

For instance, $V_{m,fb}(i)$ may represent the variance of the i-th signal component of a set of the at least one set of signal components of the first set of signal components, the set of the at least one set being associated with the m-th channel and subband fb. Accordingly, for this example, a set of the at least one set represents a subsubset of signal components as mentioned above. Furthermore, it may be assumed that variances $V_{m,fb}(i)$ have been sorted in decreasing order.

Then, the subset of relevant components of the respective set of the at least one set of signal components may be extracted based on the following pseudo-code:

```
aSum = 0
tSum = Σ_{i=0}^{length(V_{m,fb})-1} V_{m,fb}(i)
for i = 0 to length (V_{m,fb}) - 1
  aSum = aSum + V_{m,fb}(i);

  if aSum / tSum > thr_ind
    exit for loop
  End
End
vIdx_{m,fb} = i
```

Thus, this example code may determine how many signal components of the set of the at least one set of signal components of the first set of signal components are needed such that the accumulated variance divided by the sum of all variances exceeds the first accuracy criteria thr_ind. For instance, this first accuracy criteria thr_ind may be set to 0.9999, but any other well-suited threshold may also be used. This first accuracy criteria may indicate that signal components with large associated variances represent significant dynamics in the audio/video scene, while those with lower variances represent less detailed information and can be discarded. Accordingly, only the signal components of the set of the at least one set of signal components being associated with the $vIdx_{m,fb}$ highest variances are selected for the respective subset of relevant signal components.

For instance, in the set of first signal components at least one set of the at least one set of signal components of the first set of signal components may be replaced by the respective at least one subset of relevant signal component.

Furthermore, a second embodiment of an extracting method may be performed comprising extracting from each of at least one set of signal components of the second set of signal components a separate subset of relevant signal components, wherein each subset of relevant signal components represents a part of the multi-channel signal associated with the respective set of signal components of the second set of signal components in accordance with a second accuracy criteria.

Each of the at least one set of signal components of the second set of signal components may be associated with one component analysis of the second component analysis.

For instance, one set of the at least one set of signal components of the second set of signal components may represent a subset of signal components of the second set of signal components determined by means of the inter-channel component analysis. In this example case, the subset of relevant signal components may represent the signal (or an approximation of this signal) of the respective at least two channels of the multi-channel signal.

Or, as another example, one set of the at least one set of signal components of the second set of signal components may represent a subsubset of signal components of the second set of signal components determined by means of the component analysis for a respective subband of respective at least two channels. In this example case, the subset of relevant signal components may represent the signal (or an approximation of this signal) of the respective subband of the respective at least two channel of the multi-channel signal.

Furthermore, for instance, second extraction information may be provided indicative which signal components of a set of the at least one set of signal components of the second set of signal components have been extracted to the respective subset of relevant signal components.

Further, as an example, this second extraction information may be used by in order to reconstruct the second signal components before the first component synthesis is performed.

The second accuracy criteria may represent any well-suited criteria configured to determine the quality of the part of the multi-channel signal reconstructed by means of the respective set of relevant signal components.

Thus, for instance, only those signal components of a set of the at least one set of signal components are selected which are sufficient to represent the respective part of the multi-channel signal at desired accuracy, whereas the remaining signal components may be discarded. These selected signal components may define the corresponding subset of relevant signal components. The number of selected components of a set of the at least one set of signal components of the second set of signal components may represent an extraction information associated with the respective set of the at least one set of signal components.

For instance, a measure of relevance may be determined for each signal component of each of the at least one set of signal components of the second set of signal components, the measure of relevance indicating the relevance of the associated signal component with respect to the part of multi-channel signal associated with the respective set of signal components of the second set of signal components.

As an example, the measure of relevance associated with a signal component may represent a variance. For instance, this variance may be computed by means of the respective component analysis when determining the second set of signal components, or when determining a subset of signal components of the second set of signal components, or when determining a subsubset of signal components of the second set of signal components.

For instance, $V_mv_{fb}(i)$ may represent the variance of the i-th signal component of a set of the at least one set of signal components of the second set of signal components, the set of the at least one set being associated with at least two channels of the at least two channels and with subband fb. Accordingly, for this example, a set of the at least one set represents a subsubset of signal components as mentioned above. As a non-limiting example, it may be assumed that the set of the at least one set of signal components of the second set of signal components is associated with all M channels of the at least two channels of the multi-channel signal. Furthermore, it may be assumed that variances $V_{m,fb}(i)$ have been sorted in decreasing order.

Then, the subset of relevant components of the respective set of the at least one set of signal components may be extracted based on the following pseudo-code:

```
aSum = 0

tSum = Σ_{i=0}^{length(V_mv_fb)-1} V_mv_fb(i)

for i = 0 to length (V_mv_fb) - 1
  aSum = aSum + V_mv_fb(i);

  if aSum / tSum > thr_ind2
    exit for loop
  End
End
vIdx_mv_fb = i
```

Thus, this example code may determine how many signal components of the set of the at least one set of signal components of the second set of signal components are needed such that the accumulated variance divided by the sum of all variances exceeds the second accuracy criteria thr_ind2. For instance, this second accuracy criteria thr_ind2 may be set to 0.9995, but any other well-suited threshold may also be used. This second accuracy criteria may indicate that signal components with large associated variances represent significant dynamics in the audio/video scene, while those with lower variances represent less detailed information and can be discarded. Accordingly, only the signal components of the set of the at least one set of signal components being associated with the $vIdx_mv_{fb}$ highest variances are selected for the respective subset of relevant signal components of the second set of signal components.

For instance, in the set of second signal components at least one set of the at least one set of signal components of the second set of signal components may be replaced by the respective at least one subset of relevant signal components. The second embodiment of an extracting method may be performed after the second component analysis is performed.

For instance, applying the second component analysis may be based on the at least one extracted subset of relevant signal components of the first set of signal components.

For instance, the down-sampled representation of the multi-channel signal may comprises the at least one extracted subset of relevant signal components of the second set of signal components.

Accordingly, a further data rate reduction may be performed based on the described extracting.

According to a further aspect, the first method comprising at least one of: applying the second component analysis based on the at least one extracted subset of relevant signal components of the first set of signal components; and the down-sampled representation of the multi-channel signal comprises the at least one extracted subset of relevant signal components of the second set of signal components.

According to a further aspect, the first method comprising determining signal scene information, the signal scene information comprising the down-sampled representation of the multi-channel signal, a first set of analysis components associated with the first component analysis, wherein the first set of analysis components is configured to be used in combination with the first set of signal components for reconstruction of the multi-channel signal, and a second set of analysis components associated with the second component analysis, wherein the second set of analysis components is configured to be used in combination with the second set of signal components for reconstruction of the first set of signal components.

Furthermore, for instance, the signal scene information may comprise the first and/or second extraction information.

According to a further aspect, the second method comprising accessing signal scene information, the signal scene information comprising the down-sampled representation of the multi-channel signal, a first set of analysis components associated with the second component synthesis, wherein the first set of analysis components is configured to be used in combination with the first set of reconstructed signal components for reconstruction of the multi-channel signal; and a second set of analysis components associated with the first component synthesis, wherein the second set of analysis components is configured to be used in combination with down-sampled representation of the multi-channel signal for reconstruction of the second set of signal components.

The first set of analysis components may represent the first set of analysis components as mentioned above and is configured to be used in combination with the first set of signal components for reconstruction of the multi-channel signal.

The second set of analysis components may represent the second set of analysis components as mentioned above and is configured to be used in combination with the second set of signal components for reconstruction of the first set of signal components.

It has to be understood that a corresponding receiver for reconstructing the down-sampled multi-channel signal also falls within in the scope of the protection. This receiver may be configured to apply any described detail with respect to the first method in reverse in order to reconstruct the multi-channel signal.

Further aspects of the invention will be apparent from and elucidated with reference to the detailed description presented hereinafter.

DETAILED DESCRIPTION OF NON-LIMITING EMBODIMENTS OF THE INVENTION

In the following detailed description, non-limiting embodiments of the present invention will be described in the context of embodiment of methods and apparatuses.

Figure 1:
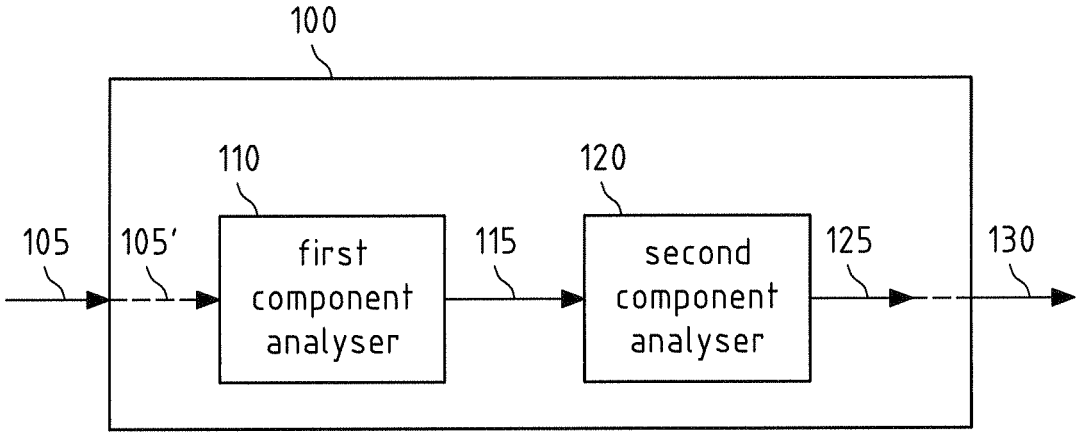
FIG. 1 is a schematic block diagram which illustrates a first embodiment of an apparatus.

FIG. 1 is a schematic block diagram which illustrates a first embodiment of an apparatus 100. This first embodiment of an apparatus 100 will be described in conjunction with the flow chart of a first embodiment of a method depicted in FIG. 2.

Apparatus 100 is fed by a multi-channel signal 105. This multi-channel signal 105 may comprise at least two channels, wherein each of the at least two channels is associated with a signal.

For instance, the multi-channel signal 105 may represent a "traditional two-channel stereo" signal, or a 5.1 or 7.2 channel configuration or any other multi-channel configuration. Furthermore, as an example, the multi-channel signal 105 may represent a multi-view signal, wherein different channels of the multi-channel signal 105 are associated with different aural views to an audio scene. Thus, each of said different channels is associated with a signal being associated with the respective aural view of the different aural views.

For instance, the multi-channel signal 105 may represent a mixture of a multi-view signal and at least one further signal.

The apparatus 100 is configured to perform a concatenated component analysis based on a time-frequency representation 105' of the multi-channel signal 105 for determining a down-sampled representation 130 of the multi-channel signal 105.

For instance, the multi-channel signal 105 may be in the time-frequency domain. In this case, the multi-channel signal 105 may be directly fed to first component analyser.

As another example, the apparatus 100 may comprise a converter (not depicted in FIG. 1) configured to transform the multi-channel signal 105 into the time-frequency representation 105'. The dashed line 105' in FIG. 1 indicates that there may be some further signal processing with respect to the multi-channel signal 105 before being fed to the first component analyser 110.

Figure 2:
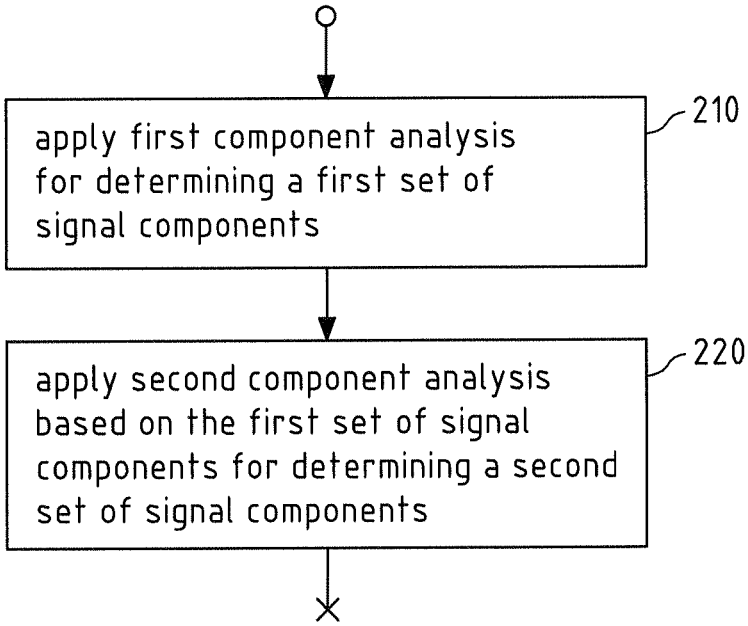
FIG. 2 is a flow chart illustrating a first embodiment of a method.

The first component analyser 110 is configured to perform a first component analysis for determining a first set of signal components 115 representing the multi-channel signal, as exemplarily indicated by reference 210 in FIG. 2.

The first component analysis may represent an analysis procedure which is configured to perform a first decorrelation of the time-frequency representation of the multi-channel signal. For instance, this first decorrelation may be directed to each of at least one channel of the at least two channels of the multi-channel signal 105, i.e. the first decorrelation may be performed to decorrelate each channel of at least one channel of the at least two channels separately, thereby representing an intra-channel decorrelation. Furthermore, as an example, this first decorrelation may perform a decorrelation between at least two channels of the at least two channels of the multi-channel signal 105, thereby representing an inter-channel decorrelation.

Furthermore, as an example, the first component analysis may determine a set of first analysis components, wherein this set of first analysis components is configured to be used in combination with the first set of signal components for reconstruction of the multi-channel signal. For instance, the multi-channel signal may be reconstructed by a linear combination of the first analysis components and the first set of signal components.

The first set of signal components 115 represents the multi-channel signal after this first component analysis has been performed. Thus the multi-channel signal (or an approximation of the multi-channel signal) may be reconstructed by means of a corresponding component synthesis applied to the first set of signal components 115, the first component synthesis representing the inverse operation of the first component analysis.

For instance, the first component analysis may by performed by means of a principal component analysis (PCA) or an independent component analysis (ICA), but any other well-suited component analysis may also be used for carrying out the first component analysis.

Due to the first component analysis the output data rate of the first component analyser 110 may be reduced compared to the input data rate of the time-frequency domain representation 105' of the multi-channel signal.

The second component analyser 120 is configured to perform a second component analysis based on the first set of signal components for determining a second set of signal components 125 representing the multi-channel signal, as exemplarily indicated by reference 220 in FIG. 2.

The second component analysis may be different compared to first component analysis. For instance, the first component analysis may perform a first decorrelation of the time-frequency representation of the multi-channel signal, as mentioned above, and the second component analysis may perform a second decorrelation of the multi-channel signal based on the first set of signal components, wherein the first decorrelation differs from the second decorrelation. As an example, the second decorrelation may be one of the above-mentioned inter-channel decorrelation and intra-channel decorrelation and the first decorrelation may be remaining inter-channel or intra-channel decorrelation.

Furthermore, as an example, the second component analysis may determine a set of second analysis components, wherein this set of second analysis components is configured to be used in combination with the second set of signal components for reconstruction of the first set of signal components. For instance, the first set of signal components may be reconstructed by a linear combination of the second analysis components and the second set of signal components.

The second set of signal components 125 represents the multi-channel signal after this second component analysis has been performed. Thus the first set of signal component 115 (or an approximation of the first set of signal components 115) may be reconstructed by means of a corresponding component synthesis applied to the second set of signal components 125, the second component synthesis representing the inverse operation of the second component analysis.

For instance, the second component analysis may by performed by means of a principal component analysis (PCA) or an independent component analysis (ICA), but any other well-suited component analysis may also be used for carrying out the second component analysis.

Thus, due to the concatenated component analysis different statistical properties of the multi-channel signal may be used for a two-stage component analysis in order to reduce the data rate of the multi-channel signal, wherein the first component analysis is directed to exploit one of the different statistical properties and the second component analysis is directed to exploit another of the different statistical properties.

For instance, the multi-channel signal is associated with at least two channels. Furthermore, as an example, the first component analysis comprises for each channel of at least one channel of the at least two channels applying an intra-channel component analysis for determining a subset of signal components representing the signal of the respective channel.

The down-sampled representation 130 of the multi-channel signal may comprise the second set of signal components 125. Due to the two-stage decomposition of the multi-channel signal the data rate of the down-sampled representation 130 of the multi-channel signal is reduced compared to the inputted multi-channel signal 105. The dashed arrow with respect to reference sign 130 indicates that there may be performed further signal processing to second set of signal components 125.

Figure 9:
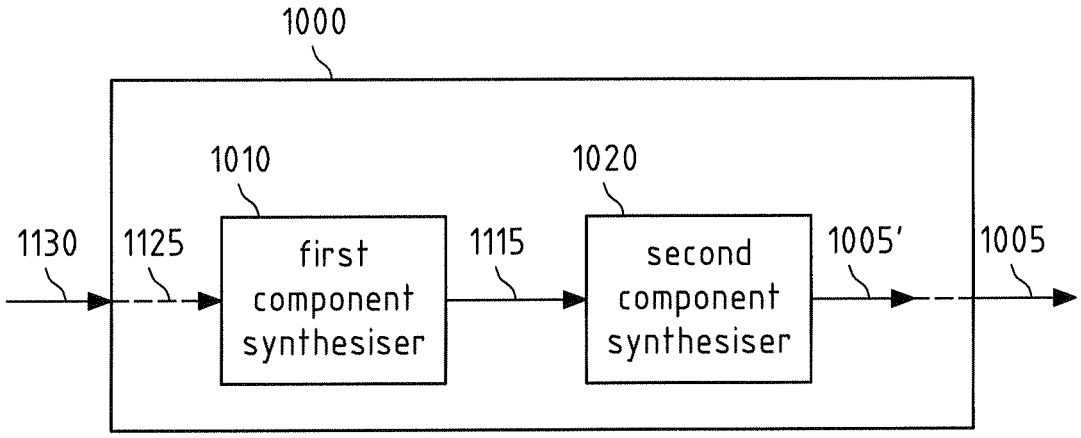
FIG. 9 is a schematic block diagram which illustrates a fourth embodiment of an apparatus.

FIG. 9 is a schematic block diagram which illustrates a fourth embodiment of an apparatus 1000. This fourth embodiment of an apparatus 1000 will be described in conjunction with the flow chart of a second embodiment of a method depicted in FIG. 10.

The fourth embodiment of an apparatus 1000 is configured to have access to signal 1130 which may represent or comprise the down-sampled representation 130 of the multi-channel signal. For instance, as a non-limiting example, signal 1130 may represent the down-sampled representation 130 of the multi-channel after being transmitted over a channel.

The apparatus 1000 is configured to perform a concatenated reconstruction of the multi-channel signal based on the down-sampled representation 130 of the multi-channel signal. The apparatus 1000 comprises a first component synthesiser 1010 configured to apply a first component synthesis for determining a first set of reconstructed signal components 1115 representing the multi-channel signal, as indicated by reference sign 1210 in FIG. 10, and a second component synthesizer 1020 configured to apply a second component synthesis based on the first set of reconstructed signal components 1115 for determining a reconstructed representation 1005' of the multi-channel signal.

The first component synthesis may represent an inverse operation of the second component analysis. Thus the first set of signal components 115 (or an approximation of the first set of signal components 115) may be reconstructed, indicated by reference sign 1115 in FIG. 9, by means of the first component synthesis applied to the second set of signal components 125, which are included in the down-sampled representation 130 of the multi-channel signal of accessed signal 1130.

Furthermore, as an example, the first component synthesis may be performed based on the set of second analysis components which may be used in combination with the accessed second set of signal components.

The second component synthesis may represent an inverse operation of the first component analysis. Thus the time-frequency domain representation 105' of the multi-channel signal may be reconstructed by means of the second component synthesiser 1020 as reconstructed representation 1005' of the multi-channel signal based on the first set of reconstructed signal components 1115.

Furthermore, as an example, the second component synthesis may be performed based on the set of first analysis components which may be used in combination with the first set of reconstructed signal components 1115 for reconstruction of the multi-channel signal.

For instance, as a non-limiting example, the fourth embodiment of an apparatus 1000 may be used in a receiver in order to reconstruct the multi-channel signal.

Figure 3A:
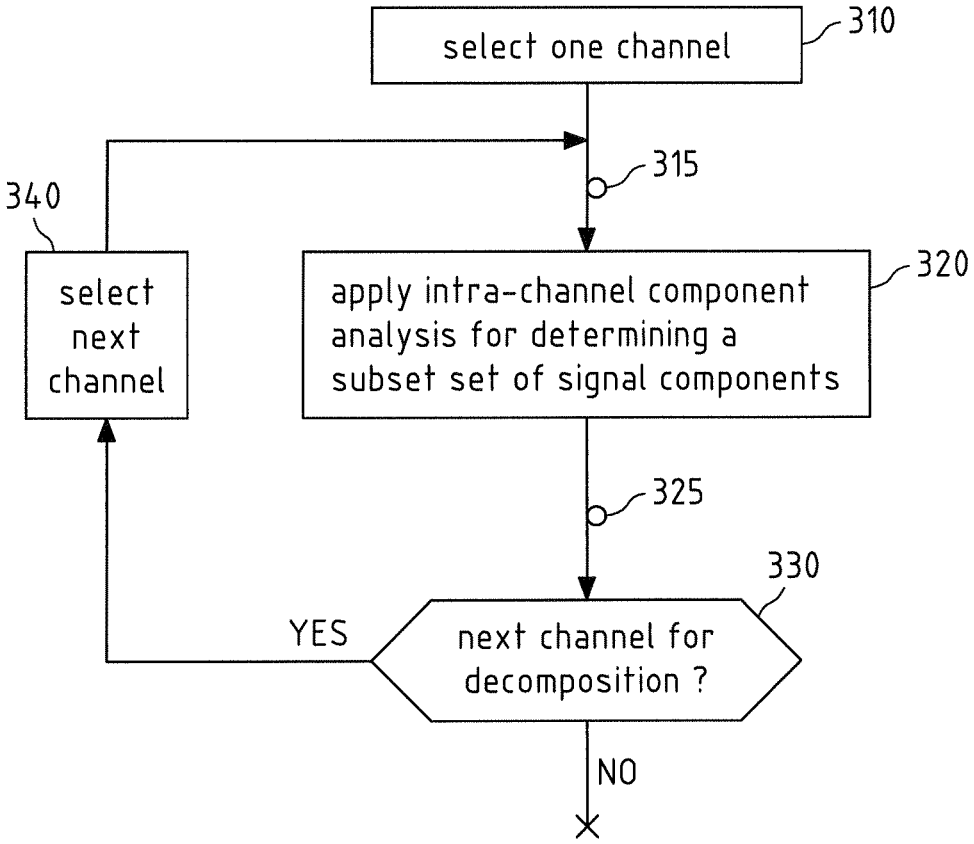
FIG. 3*a* is a first embodiment of a method of the first component analysis.

FIG. 3*a* depicts a first embodiment of a method of the first component analysis for this intra-channel component analysis. For instance, this first embodiment of a method of the first component analysis may be used for the first component analyser 110 depicted in FIG. 1 and for step 210 depicted in FIG. 2.

One of these at least two audio channels is selected, as indicated by reference sign 310 in FIG. 3*a*, and an intra-channel component analysis is applied for determining a subset of signal components representing the signal of the respective channel, as indicated by reference sign 320 in FIG. 3*a*. The intra-channel component analysis may be carried out as explained above, for example based on PCA or any other well-suited component analysis. Thus, a decorrelation of the signal of the respective channel may be performed.

Furthermore, as an example, the intra-channel component analysis may determine a subset of first analysis components, wherein this subset of first analysis components is configured to be used in combination with the subset of signal components for reconstruction of the signal of the respective channel of the multi-channel signal, e.g. by means of a linear combination. The set of first analysis components may comprise this subset of first analysis components.

Then it may be checked whether a component analysis is to be performed for a next channel of the at least two channels, as indicated by reference sign 330 in FIG. 3*a*. If there is a next channel for component analysis the method proceeds with selecting this channel, as indicated by reference sign 340, and applying the intra-channel component analysis for determining a subset of signal components representing the signal of the selected channel, as indicated by reference sign 320.

The signal components of each determined subset of signal components being associated with the respective channel are signal components of the first set of signal components. Accordingly, the first set of components comprises the at least one subset of signal components determined by the respective intra-channel component analysis (indicated by reference sign 320) of the respective channel.

Accordingly, the loop depicted in FIG. 3*a* may be performed for each of the at least one channel of the at least two channels of the multi-channel signal in order to determine at least one subset of signal components of the first set of signal components.

Furthermore, as an example, the time-frequency representation may comprise at least two sets of time-frequency representatives, wherein each set of the at least two sets of time-frequency representatives is associated with one channel of the at least two channels of the multi-channel signal.

Furthermore, in case the intra-channel component analysis is not applied for at least one channel of the at least two channels of the multi-channel signal, the signal of this at least one channel may be represented by the respective time-frequency representatives. For instance, the set of first signal components may comprise at least one subset of signal components being associated with said at least one channel for which no intra-channel component analysis has been applied, wherein each of this at least one subset of signal components comprises the respective set of time-frequency representatives being associated with the respective channel.

Accordingly, as an example, the intra-channel component analysis is performed based on the set of time-frequency representatives of the at least two sets of time-frequency representatives associated with the respective channel.

It has to be understood that the embodiment of a method depicted in FIG. 3 is not limited to the strict structure of the flowchart's loop. For example, applying the intra-channel component analysis for each of the at least one channel of the at least two channels may be performed in parallel, or, as another example, partially in parallel and partially sequentially.

Figure 10:
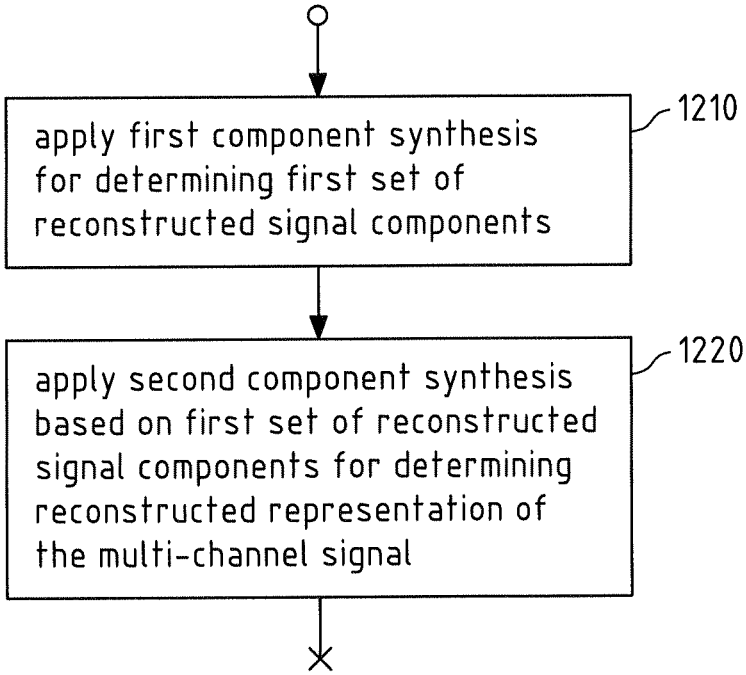
FIG. 10 is a flow chart illustrating a second embodiment of a method.

With respect to the fourth embodiment of an apparatus depicted in FIG. 9 and the second embodiment of a method depicted in FIG. 10 as counterpart to the embodiment of a method depicted in FIG. 3*a*, for instance, the second component synthesis may comprise for each channel of at least one channel of the at least two channels applying an intra-channel component synthesis for determining a reconstructed signal of the respective channel. This reconstructed signal of the respective channel may represent the above-mentioned set of time-frequency representatives being associated with the respective channel.

Figure 3B:
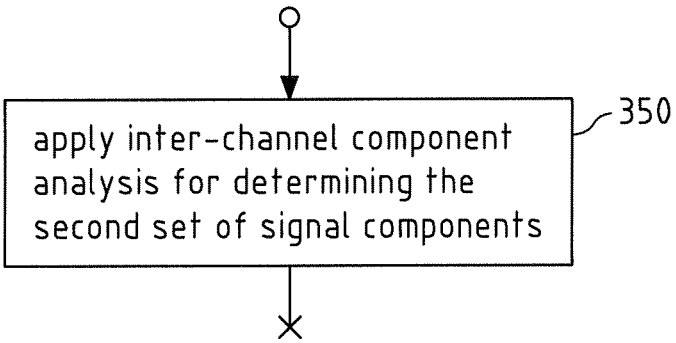
FIG. 3*b* is first embodiment of a method of an inter-channel component analysis.

FIG. 3*b* depicts a first embodiment of a method of the second component analysis representing an inter-channel component analysis. For instance, this first embodiment of a method of the second component analysis may be used for the second component analyser 120 depicted in FIG. 1 and for step 220 depicted in FIG. 2.

For instance, this inter-channel component analysis may be performed on the basis of the determined at least one subset of signal components of the first set of signal components which has been determined by the first embodiment of a method of the first component analysis as explained with respect to FIG. 3*a*.

The inter-channel component analysis, indicated by reference sign 350, is performed for determining the second set of signal components representing the multi-channel signal.

For instance, the inter-channel component analysis may be applied for at least two channels of the at least two channels of the multi-channel signal in order to determine signal components of the second set of signal components representing the signals of these at least two channels of the at least two channels of the multi-channel signal. This determining may be performed on basis of the respective subset of signal components of the first set of signal components being associated with the at least two channels of the at least two channels of the multi-channel signal.

Furthermore, as another example, in case the inter-channel component analysis is not applied for at least one channel of the at least two channels of the multi-channel signal, the signal of this at least one channel may be represented by the respective signal components of the first set of signal components.

The inter-channel component analysis may be carried out as explained above, for example based on PCA or any other well-suited component analysis. Thus, a decorrelation of the at least two channels of the at least two channels of the multi-channel signal may be performed.

Furthermore, as an example, the inter-channel component analysis may determine analysis components of the set of second analysis components, wherein these determined analysis components are configured to be used in combination with the second set of signal components for reconstruction of the signal of the at least one channel of the multi-channel signal, e.g. by means of a linear combination.

With respect to the fourth embodiment of an apparatus depicted in FIG. 9 and the second embodiment of a method depicted in FIG. 10 as counterpart to the embodiment of a method depicted in FIG. 3*b*, for instance, the first component synthesis may represent an inter-channel synthesis of at least two channels of the at least two channels associated with the multi-channel signal, the inter-channel synthesis representing the inverse operation of the inter-channel component analysis.

Figure 4A:
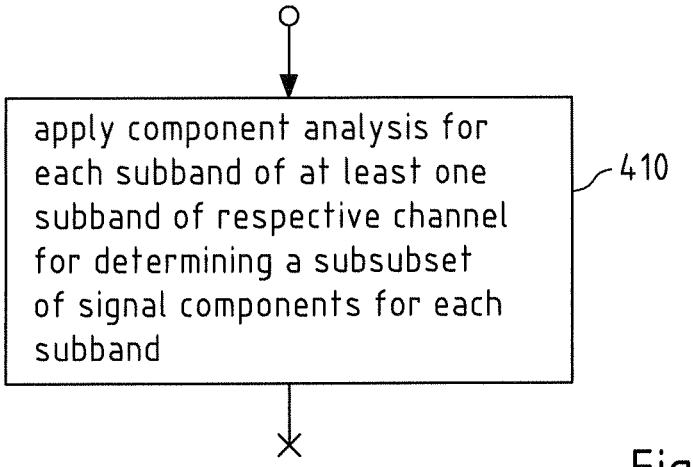
FIG. 4*a* a first embodiment of a method of a component analysis for one channel.

FIG. 4*a* depicts a first embodiment of a method of a component analysis for one channel. For instance, this embodiment of a method of a component analysis may be used for the above-mentioned intra-channel component analysis for determining a subset of signal components of a respective channel, as indicated by reference sign 320 in FIG. 3. Thus, the first embodiment of a method of a component analysis for one channel may be inserted between the reference signs 315 and 325 in FIG. 3*a* and may represent a part of the first embodiment of a method of inter-channel component analysis depicted in FIG. 3*a*.

Each channel of the at least one channel of the at least two channels is associated with a frequency band. The width of the frequency band of one channel may depend on the signal associated with the respective channel and can either be fixed or variable.

Furthermore, the frequency band of one channel of the at least one channel is associated with at least one subband of the frequency band of the respective channel.

A component analysis is applied for each subband of at least one subband of the frequency band of the respective channel for determining a subsubset of signal components for each subband of the at least one subband of the respective channel, as indicated by reference sign 410 in FIG. 4*a*. A subsubset of signal components represents signal components of the first set of signal components representing the signal in the respective subband of the respective channel of the multi-channel signal.

Furthermore, as an example, the component analysis associated with a subband of the at least one subband of the frequency band of the respective channel may determine a subsubset of first analysis components, wherein this subsubset of first analysis components is configured to be used in combination with the respective subsubset of signal components for reconstruction of the signal of respective subband of the respective channel of the multi-channel signal, e.g. by means of a linear combination. The set of first analysis components may comprise this subsubset of first analysis components.

This determining may be performed based on the time-frequency representatives of the set of time-frequency representatives of the respective channel and being associated with the respective subband of the respective channel. For instance, each set of time-frequency representatives associated with one channel may comprise at least one subset of time-frequency representatives, wherein each subset of time-frequency representatives may be associated with one subband of the respective channel and may comprise time-frequency representatives representing the signal in the respective subband of the respective channel.

For instance, the above-mentioned subset of signal components being associated with the respective channel may comprise the at least one subsubset of signal components determined by means of the first embodiment of a method of a component analysis for one channel depicted in FIG. 4*a*. Accordingly, each subsubset of signal components comprises signal components representing the signal in the subband of the respective channel determined by the applied component analysis.

Thus, for example, a plurality of intra-channel component analysis may be performed for different subbands of a frequency band of a respective channel. For instance, a decorrelation of signals in different subbands of a respective channel may be performed, which may enhance the quality of decorrelation.

With respect to the fourth embodiment of an apparatus depicted in FIG. 9 and the second embodiment of a method depicted in FIG. 10 as counterpart to the embodiment of a method depicted in FIG. 4*a*, for instance, the second component synthesis may represent the above-mentioned intra-channel component channel, wherein this intra-channel component synthesis comprises for a respective channel applying a component synthesis for each subband of at least one subband of the frequency band of the respective channel for determining a reconstructed subsignal of the multi-channel signal associated with the respective subband of the respective channel for each subband of the at least one subband.

For instance, this reconstructed subsignal may represent reconstructed time-frequency representatives representing the signal in the respective subband of the respective channel.

Figure 4B:
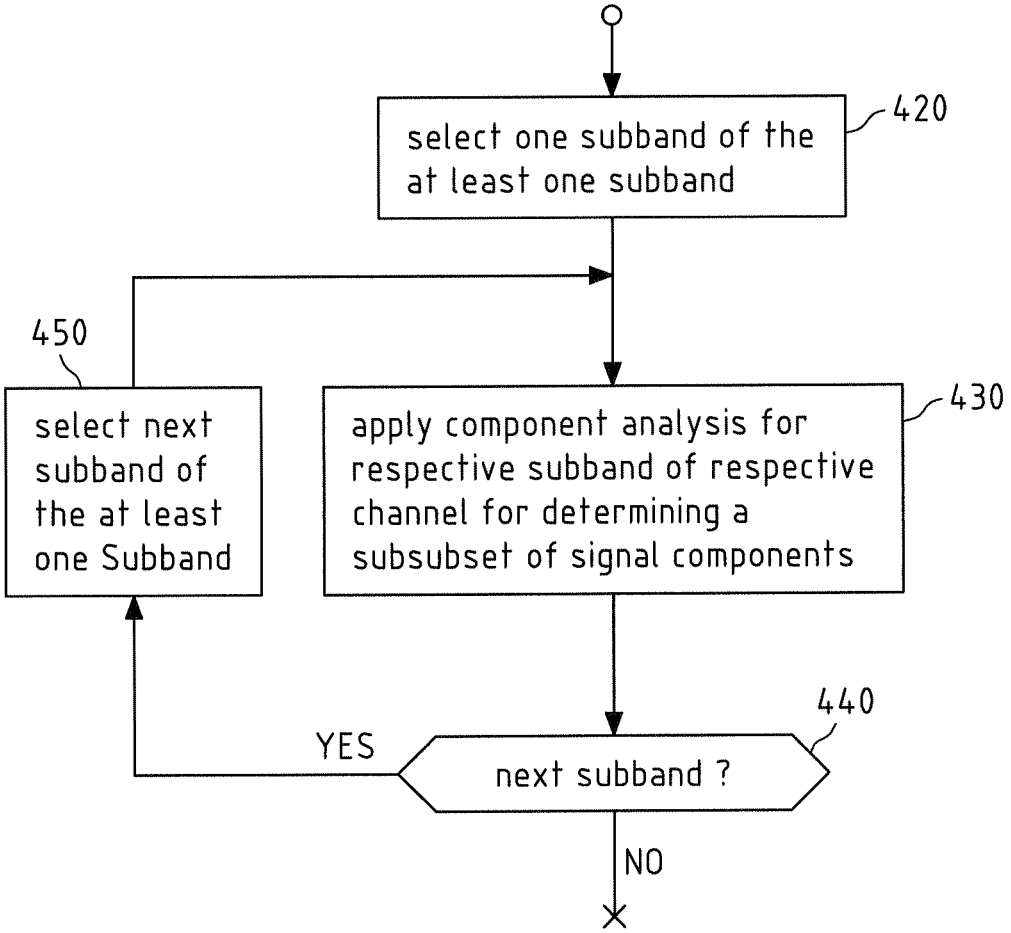
FIG. 4*b* a second embodiment of a method of a component analysis for one channel.

FIG. 4*b* depicts a second embodiment of a method of a component analysis for one channel which may be used for performing the first embodiment of a method of a component analysis for one channel depicted in FIG. 4*a*.

One subband of the at least one subband of the respective channel is selected, as indicated by reference sign 420 in FIG. 4*b*.

Then a component analysis is applied for the respective subband of the respective channel for determining a subsubset of signal components of the first set of signal components, as indicated by reference sign 430. This component analysis may be performed as explained above.

Then it may be checked whether there is another subband of the at least one subband associated with the respective channel, as indicated by reference sign 440. If there is a next subband the method proceeds with selecting this next subband, as indicated by reference sign 450, and applying the component analysis for the selected subband for determining the subsubset of signal component being associated with the selected subband and the respective channel (indicated by reference sign 430).

Accordingly, the loop depicted in FIG. 4*b* may be performed fore each of the at least one subband associated with the respective channel in order to determine at least one subsubset of signal components of the first set of signal components. Thus, this at least one subsubset of signal components may represent the subset of signal components of the first set of signal components representing the signal in the respective channel in accordance with the applied at least one component analysis performed by step 430.

Figure 5A:
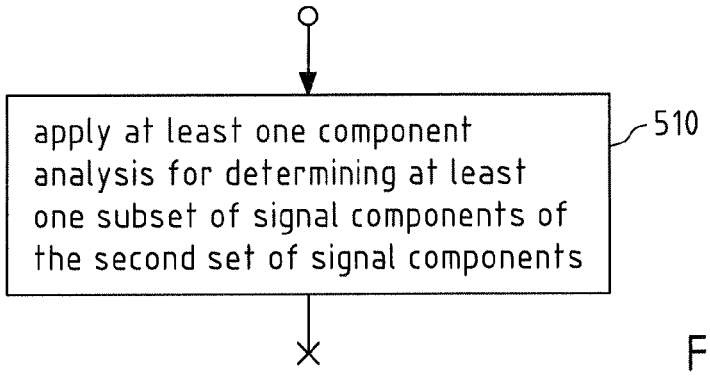
FIG. 5*a* is a second embodiment of a method of an inter-channel component analysis.

FIG. 5*a* depicts a second embodiment of a method of an inter-channel component analysis. For instance, this second embodiment of a method of on inter-channel component analysis may be used for the first embodiment of a method of inter-channel component analysis depicted in FIG. 3*b* and may be used for the second component analyser 130 depicted in FIG. 1 and for step 230 depicted in FIG. 2. For instance, this second embodiment of a method of an inter-channel component analysis may be used in combination with an inter-channel component analysis based on one of the embodiment of a methods depicted in FIGS. 4*a* and 4*b*.

The second embodiment of a method of inter-channel component analysis comprises applying at least one component analysis for determining at least one subset of signal components of the second set of signal components, as indicated by reference sign 510 in FIG. 5*a*. Each of the at least one component analysis is associated with at least two channels of the at least two channels of the multi-channel signal and with a subband of a frequency band associated with the respective at least two channels of the at least two channels.

Thus, each determined subset of signal components comprises signal components of the second set of signal components representing the signals of the respective at least two channels of the multi-channel signal in the respective subband.

The determining is based on the first set of signal components. Accordingly, signal components of the first set of signal components representing the signals of the respective at least two channels in the respective subband are used as basis for the component analysis of the inter-channel component analysis.

For instance, under the assumption of the example notation regarding the subsubset of signal components of the first set of signal components, one component analysis of the at least one component analysis of the inter-channel component analysis may be applied based on the respective at least two subsubsets of signal components of the first set of signal components, wherein a subsubset of signal components of the at least two subsubsets of signal components is associated with the respective subband of the respective channel of the respective at least two channels.

The second embodiment of a method of inter-channel component analysis may comprise a component analysis for each subband of a frequency band associated with the at least two channels.

Furthermore, as an example, a component analysis of the at least one component analysis of the inter-channel component analysis may determine a subset of analysis components of the set of second analysis components, wherein the subset of analysis components is configured to be used in combination with the respective subset of second set of signal components for reconstruction of the respective at least two subsubsets of signal components of the first set of signal components.

Figure 5B:
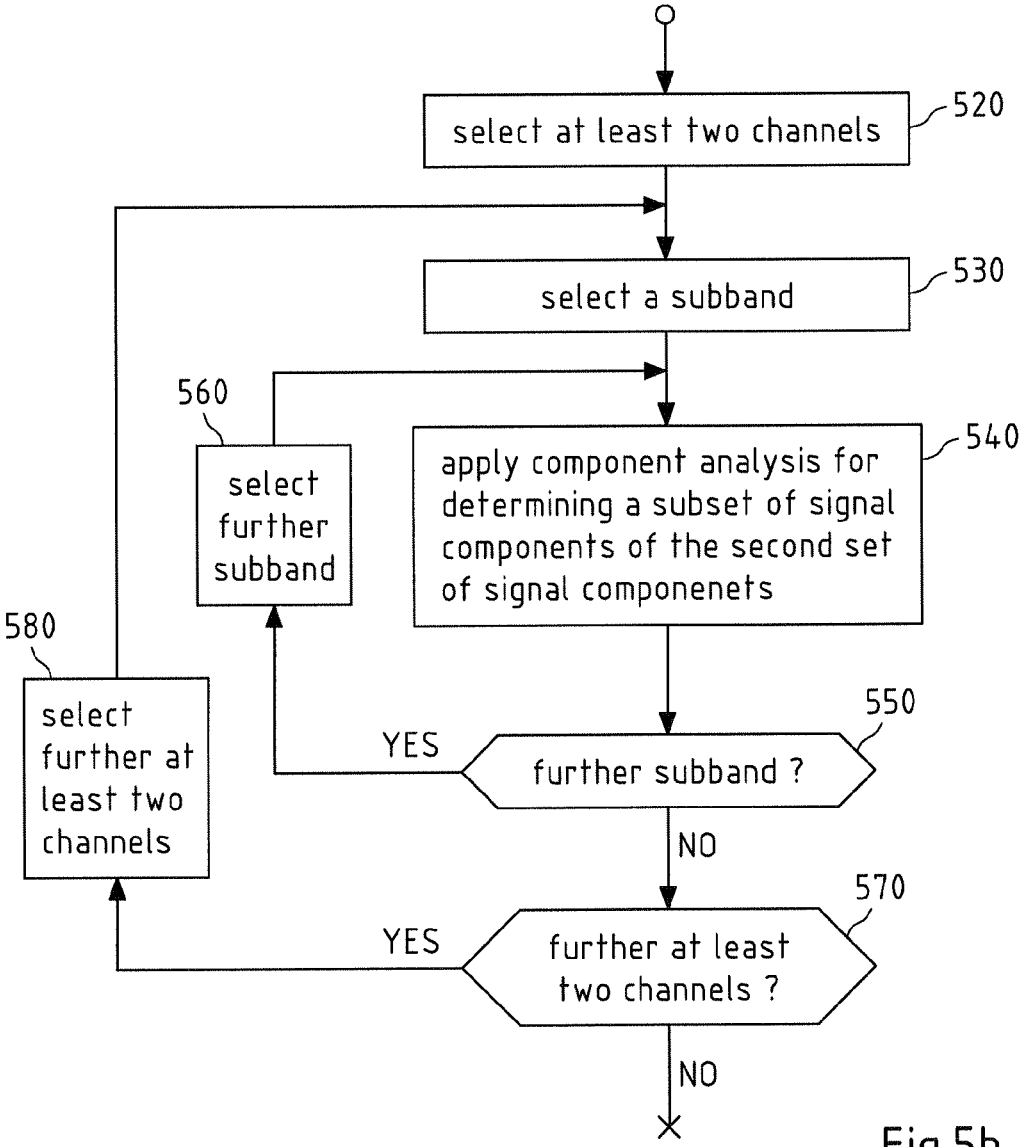
FIG. 5*b* is a third embodiment of a method of an inter-channel component analysis.

With respect to the fourth embodiment of an apparatus depicted in FIG. 9 and the second embodiment of a method depicted in FIG. 10 as counterpart to the embodiment of a method depicted in FIG. 5*b*, for instance, the first component synthesis may represent an inter-channel synthesis of at least two channels of the at least two channels associated with the multi-channel signal, the inter-channel synthesis comprising applying at least one component synthesis for determining at least one subset of reconstructed signal components of the first set of reconstructed signal components, wherein each of the at least one component synthesis is associated with at least two channels of the at least two channels of the multi-channel signal and with a subband of a frequency band associated with the respective at least two channels of the at least two channels, each determined subset of reconstructed signal components representing a reconstructed signal components of the first set of reconstructed signal components representing the signals of the respective at least two channels of the multi-channel signal in the respective subband.

For instance, each determined subset of reconstructed signal components may represent a reconstructed subsubset of signal components associated with the respective subband of the respective channel of the respective at least two channels.

Furthermore, as an example, the first component synthesis may be performed based on the set of second analysis components, as explained above.

FIG. 5*b* depicts a third embodiment of a method of an inter-channel component analysis which may be used for performing the second embodiment of a method of an inter-channel component analysis.

At least two channels of the multi-channel signal are selected, as indicated by reference sign 520, and a subband of a frequency band associated with these at least two channels is selected, as indicated by reference sign 530.

Then a component analysis is applied for determining a subset of signal components of the second set of signal components representing the signals of the respective at least two channels of the multi-channel signal in the respective subband (indicated by reference sign 540), as explained above.

Then it is checked whether there is a further subband associated with these at least two channels, as indicated by reference sign 550, and if there is a further subband, this subband is selected (indicated by reference sign 560) and a component analysis is applied for determining a subset of signal components of the second set of signal components representing the signals of the respective at least two channels of the multi-channel signal in the selected subband, as indicated by reference sign 540.

If there is no further subband, the method process with checking whether there are further at least two channels of the multi-channel signal to be used for inter-channel component analysis, as indicated by reference sign 570, and if there are further at least two channels, these at least two channels are selected (indicated by reference sign 580) and the method proceeds with selecting a subband of the frequency band associated with the selected at least two channels.

For instance, according to method depicted in FIG. 5*b*, the inter-channel component analysis may be performed for a plurality of sets of at least two channels, thereby applying component analysis for subbands of the frequency bands associated with the at least two channels of each set of the plurality of sets of at least two channels.

Furthermore, the inner loop regarding the subbands and the outer loop regarding the selection of at least two channels may be exchanged, and, as another example, parts of the loops or the complete loops may be performed in parallel.

As another example, the loop regarding the selection of at least two channels may be discarded. For instance, all the channels of the at least two channels of the multi-channel signal may be selected.

Figure 6A:
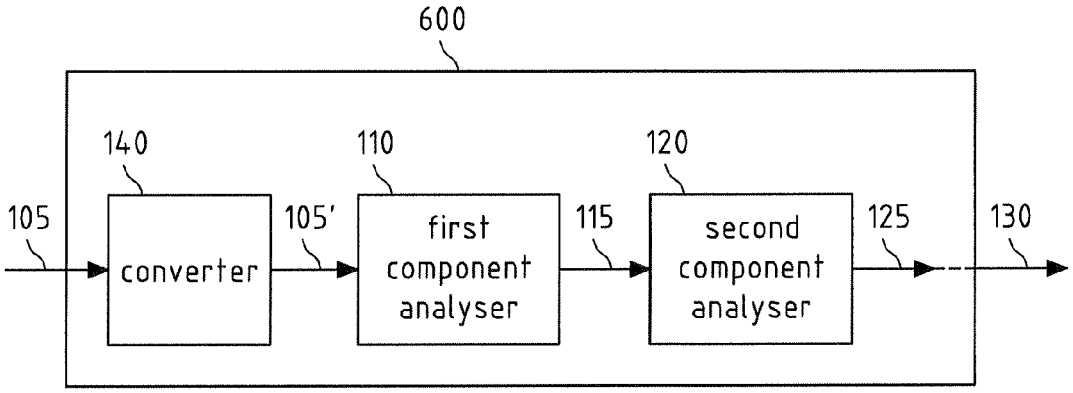
FIG. 6*a* is a schematic block diagram which illustrates a second embodiment of an apparatus.

FIG. 6*a* depicts a schematic block diagram which illustrates a second embodiment of an apparatus 600. This second embodiment of an apparatus 600 is based on the first embodiment of an apparatus 100. Accordingly, the explanations presented with the respect to first embodiment of an apparatus 100 also hold for the second embodiment of an apparatus 600.

Compared to the first embodiment of an apparatus 100, the second embodiment of an apparatus 600 comprises a converter 140 configured to convert a time-domain multichannel representation of the multi-channel signal to the time-frequency representation 105' of the multi-channel signal. For instance, the multi-channel signal 105 may represent this time-domain representation of the multi-channel signal.

The time-frequency representation comprises at least two sets of time-frequency representatives, each set of the at least two sets of time-frequency representatives being associated with one channel of the at least two channels of the multi-channel signal. Furthermore, each set of the at least two set of time-frequency representatives may comprise at least one subset of time-frequency representatives, wherein each time-frequency representative of a subset of the at least one subset is associated with a frequency component of the frequency band of the respective channel and with different point in times. For instance, the time-frequency representatives of a subset of the at least one subset are associated with the respective frequency component and a time frame.

For instance, the frequency component of the frequency band of the respective channel may correspond to the above-mentioned subband of the frequency band of the respective channel, but, as another example providing a higher resolution in frequency, one subband of the frequency band of the respective channel my be associated with at least two frequency components.

For instance, this converting may be based on a Fourier Transformation, e.g. implemented by means of a Fast Fourier Transformation (FFT) or a Discrete Fourier Transformation (DFT) or any other well-suited Fourier Transformation, and/or by means of a Discrete Cosine Transformation (DOT) and/or by means of any other suited transformation.

Accordingly, the time-frequency representation 105' of the multi-channel signal may be used for one or more of the above-mentioned component analysis.

As an example with respect to the embodiment of a methods depicted in FIGS. 4*a* and 4*b*, applying a component analysis for a respective subband of a respective channel for determining a subsubset of signal components of the first set of signal components may be performed based on the set of time-frequency representatives associated with this respective channel and with at least one subset of time-frequency representatives of this set of time-frequency representatives, the at least one subset of time-frequency representatives being associated with the respective band. I.e., the at least one frequency component associated with the at least one subset of time-frequency representatives are associated with the respective subband of the respective channel.

Figure 11:
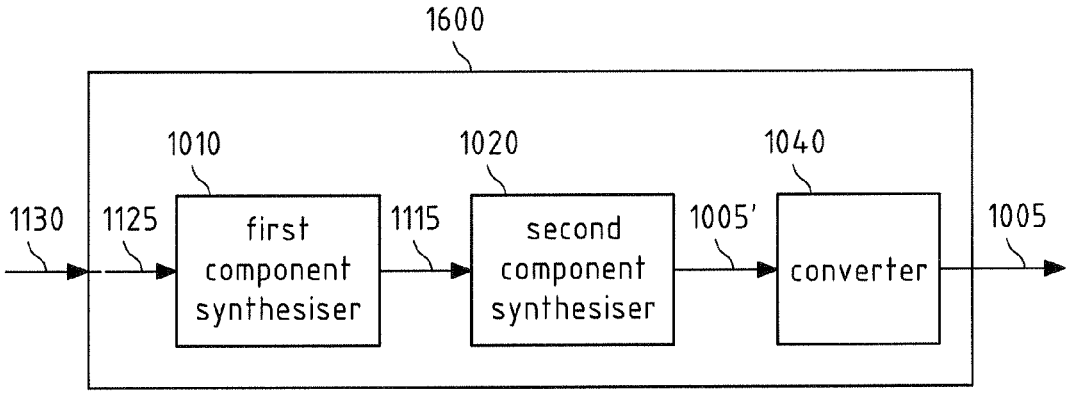
FIG. 11 is a schematic block diagram which illustrates a fifth embodiment of an apparatus.

FIG. 11 depicts a schematic block diagram which illustrates a fifth embodiment of an apparatus 1600. This fifth embodiment of an apparatus 1600 is based on the fourth embodiment of an apparatus 1000. Accordingly, the explanations presented with the respect to fourth embodiment of an apparatus 1000 also hold for the second embodiment of an apparatus 600.

Compared to the fourth embodiment of an apparatus 1000, the fifth embodiment of an apparatus comprises a converter 1040 configured to convert a time-frequency representation 1005' of the multi-channel signal to time-domain multichannel representation 1005 of the multi-channel signal.

Figure 6B:
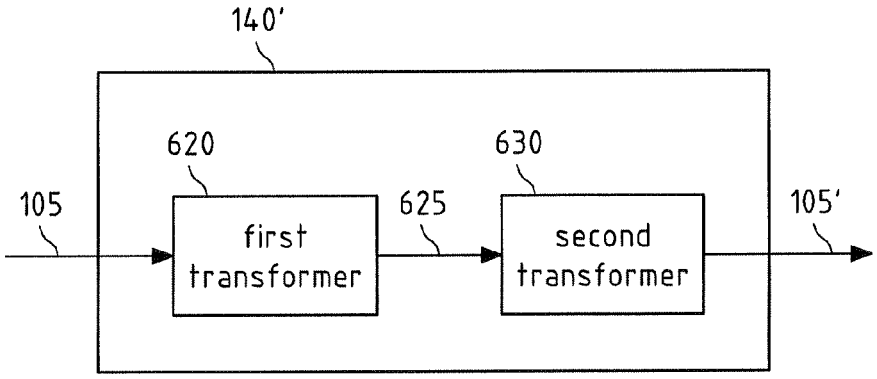
FIG. 6*b* a schematic block diagram which illustrates an embodiment of a converter.

Thus, converter 1040 may represent an inverse converter with respect to the converter 140 of the second embodiment of an apparatus 600 depicted in FIG. 6*a* and/or to the converter 140' depicted in FIG. 6*b*.

FIG. 6*b* depicts a schematic block diagram which illustrates an embodiment of a converter 140' comprising a first transformer 620 and a second transformer 630. For instance, this converter 140' may be used as converter 140 depicted in FIG. 6*a*.

The first transformer 620 is configured, for each channel of the at least two channels, to transform the time-domain representation of the respective channel of the time-domain representation into a frequency domain representation.

As an example, the time-domain representation of a channel m of the at least two channels is represented by $x_m(k)$. A frame 1 of time-domain representations $x_m(t)$ is converted by the first transformer 620 to a respective frequency domain representation $X_m[k,l]$, where k is the frequency component index (e.g. k may represent a frequency bin index) and wherein TF may represent a corresponding time-to-frequency operator:

$$X_m[k,l]=\mathrm{TF}(x_{m,l}) \tag{4}$$

This is performed for each of the channels.

As an example, a Modified Discrete Cosine Transformation may be used for the first transformer 620, as exemplarily explained in the sequel:

The TF operator is applied to each signal segment according to $$X_m[k,l]=\mathrm{TF}(x_{m,l,T}) \tag{5}$$

where m is the channel index, k is the frequency bin index, 1 is time frame index, T is the hop size between successive time frames, and TF the time-to-frequency operator. For instance, MDCT may be used as the TF operator as follows $$TF(x_{m,l,T}) = 2\cdot\sum_{n=0}^{N-1} x_{in}(n)\cdot\cos\left(\frac{2\cdot\pi}{N}\cdot\left(n+\frac{N}{4}+0.5\right)\cdot(k+0.5)\right), \quad 0\le k<\frac{N}{2}-1 \tag{6}$$

$$x_{in}(n) = w(n)\cdot x_m(n+l\cdot T)$$

where w(n) is the N-point analysis window such as sinusoidal or Kaiser-Bessel Derived (KBD) window. In MDCT, the hop size is T=N/2.

Accordingly, assuming that the at least two channels are M channels, the frequency domain representation 625 of the multi-channel signal is represented by $X_m[k,l]$ with $0<m\le M$.

The second transformer 630 is configured, for each channel of the at least two channels, to perform a two-dimensional discrete cosine transformation (2D-DCT) based on the frequency domain representation associated with the respective channel in order to determine the set of time-frequency representatives associated with the respective channel.

For instance, the set-of time-frequency representative of channel in may be represented by matrix $Y_n[k,t]$, where t is the time-index. Accordingly, k is the index of the respective frequency component and all representatives of $Y_m[k,t]$ with a fixed k and a fixed m represent the above-mentioned subset of the time-frequency representatives being associated with channel in and frequency component k.

As an example, the operation of the second transformer may be applied to the frequency domain representation based on a 2D-DCT as follows:

$$Y_m[k,t] = \left(\frac{2}{A}\right)^{\frac{1}{2}}\cdot\left(\frac{2}{B}\right)^{\frac{1}{2}}\cdot \sum_{i=0}^{A-1}\sum_{j=0}^{B-1}\left(C(i)\cdot C(j)\cdot F[i,j]\cdot\cos\left[\frac{\pi\cdot k}{2\cdot A}\cdot(2\cdot i+1)\right]\cdot\cos\left[\frac{\pi\cdot t}{2\cdot B}\cdot(2\cdot j+1)\right]\right)$$

$$F = X_m[k,u],\ \mathrm{t_start}\le u<\mathrm{t_end}$$

$$\mathrm{t_start} = grpIdx\cdot\mathrm{TF_size}$$

$$\mathrm{t_end} = \mathrm{t_start}+\mathrm{TF_size}$$

$$grpIdx = 0, 1, 2, 3, \ldots$$

$$A = N/2,\ B = \mathrm{t_end}-\mathrm{t_start},\ C(i) = \begin{cases}\frac{1}{\sqrt{2}}, & i==0\\ 1, & \text{otherwise}\end{cases}$$

where TF_size is the size of the 2D time-frequency plane. The size of matrix $Y_m$ may therefore be TF_size×A.

Figure 7A:
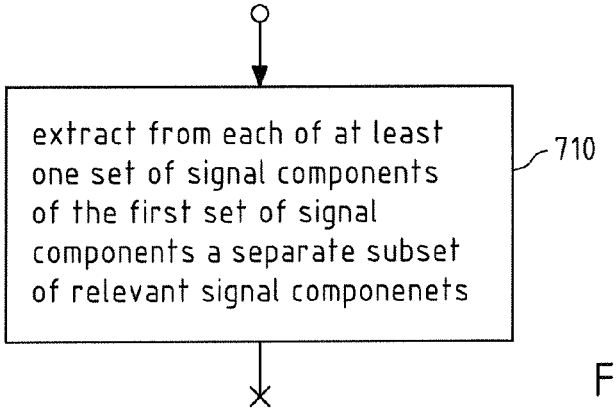
FIG. 7*a* is a first embodiment of an extracting method.

FIG. 7*a* depicts a first embodiment of an extracting method which may be applied for one of the preceding embodiments of a method.

This first embodiment of an extracting method comprises extracting from each of at least one set of signal components of the first set of signal components a separate subset of relevant signal components, as indicated by reference sign 720, wherein each subset of relevant signal components represents a part of the multi-channel signal associated with the respective set of signal components of the first set of signal components in accordance with a first accuracy criteria.

Each of the at least one set of signal components may be associated with one component analysis of the first component analysis.

For instance, one set of the at least one set of signal components may represent a subset of signal components of the first set of signal components determined by means of the intra-channel component analysis. In this example, the subset of relevant signal components may represent the signal (or an approximation of this signal) of the respective channel of the multi-channel signal.

Or, as another example, one set of the at least one set of signal components may represent a subsubset of signal components of the first set of signal components determined by means of the component analysis for a respective subband of a respective channel. In this example, the subset of relevant signal components may represent the signal (or an approximation of this signal) of the respective subband of the respective channel of the multi-channel signal.

The first accuracy criteria may represent any well-suited criteria configured to determine the quality of the part of the multi-channel signal reconstructed by means of the respective set of relevant signal components.

Furthermore, for instance, first extraction information may be provided indicative which signal components of a set of the at least one set of signal components have been extracted to the respective subset of relevant signal components.

Further, as an example, this first extraction information may be used by the fourth embodiment of an apparatus 1000 in order to reconstruct the first signal components before the second component synthesis is performed.

Thus, for instance, only those signal components of a set of the at least one set of signal components are selected which are sufficient to represent the respective part of the multi-channel signal at desired accuracy, whereas the remaining signal components may be discarded. These selected signal components may define the corresponding subset of relevant signal components. For instance, the first extraction information may comprise the number of selected components of a set of the at least one set of signal components.

For instance, a measure of relevance may be determined for each signal component of each of the at least one set of signal components of the first set of signal components, the measure of relevance indicating the relevance of the associated signal component with respect to the part of multi-channel signal associated with the respective set of signal components of the first set of signal components.

As an example, the measure of relevance associated with a signal component may represent a variance. For instance, this variance may be computed by means of the respective component analysis when determining the first set of signal components, or when determining a subset of signal components of the first set of signal components, or when determining a subsubset of signal components of the first set of signal components.

For instance, $V_{m,fb}(i)$ represents the variance of the i-th signal component of a set of the at least one set of signal components of the first set of signal components, the set of the at least one set being associated with the m-th channel and subband fb. Accordingly, for this example, a set of the at least one set represents a subsubset of signal components as mentioned above. Furthermore, it may be assumed that variances $V_{m,fb}(i)$ have been sorted in decreasing order.

Then, the subset of relevant components of the respective set of the at least one set of signal components may be extracted based on the following pseudo-code:

```
aSum = 0
tSum = Σ_{i=0}^{length(V_{m,fb})-1} V_{m,fb}(i)
for i = 0 to length (V_{m,fb}) - 1
  aSum = aSum + V_{m,fb}(i);

  if aSum / tSum > thr_ind
    exit for loop
  End
End
vIdx_{m,fb} = i
```

Thus, this example of a code may determine how many signal components of the set of the at least one set of signal components of the first set of signal components are needed such that the accumulated variance divided by the sum of all variances exceeds the first accuracy criteria thr_ind. For instance, this example of a first accuracy criteria thr_ind may be set to 0.9999, but any other well-suited threshold may also be used. This first accuracy criteria may indicate that signal components with large associated variances represent significant dynamics in the audio/video scene, while those with lower variances represent less detailed information and can be discarded. Accordingly, only the signal components of the set of the at least one set of signal components being associated with the $vIdx_{m,fb}$ highest variances are selected for the respective subset of relevant signal components.

For instance, in the set of first signal components at least one set of the at least one set of signal components of the first set of signal components may be replaced by the respective at least one subset of relevant signal component.

The first embodiment of an extracting method depicted in FIG. 7*a* may be performed before the second component analysis is performed. With respect to the flowchart depicted in FIG. 2, the first embodiment of an extracting method depicted in FIG. 7*a* may be inserted between applying the first component analysis and applying the second component analysis.

Then, for instance, applying the second component analysis may be based on the at least one extracted subset of relevant signal components of the first set of signal components.

Figure 7B:
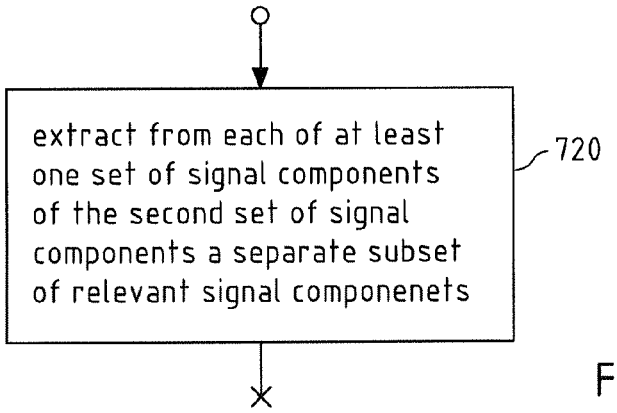
FIG. 7*b* is a second embodiment of an extracting method.

FIG. 7*b* depicts a second embodiment of an extracting method which may be applied for one of the preceding embodiments of a method.

This second embodiment of an extracting method comprises extracting from each of at least one set of signal components of the second set of signal components a separate subset of relevant signal components, as indicated by reference sign 730, wherein each subset of relevant signal components represents a part of the multi-channel signal associated with the respective set of signal components of the second set of signal components in accordance with a second accuracy criteria.

Each of the at least one set of signal components of the second set of signal components may be associated with one component analysis of the second component analysis.

For instance, one set of the at least one set of signal components of the second set of signal components may represent a subset of signal components of the second set of signal components determined by means of the inter-channel component analysis. In this example case, the subset of relevant signal components may represent the signal (or an approximation of this signal) of the respective at least two channels of the multi-channel signal.

Or, as another example, one set of the at least one set of signal components of the second set of signal components may represent a subsubset of signal components of the second set of signal components determined by means of the component analysis for a respective subband of respective at least two channels. In this example case, the subset of relevant signal components may represent the signal (or an approximation of this signal) of the respective subband of the respective at least two channel of the multi-channel signal.

Furthermore, for instance, second extraction information may be provided indicative which signal components of a set of the at least one set of signal components of the second set of signal components have been extracted to the respective subset of relevant signal components.

Further, as an example, this second extraction information may be used by the fourth embodiment of an apparatus 1000 in order to reconstruct the second signal components before the first component synthesis is performed.

The second accuracy criteria may represent any well-suited criteria configured to determine the quality of the part of the multi-channel signal reconstructed by means of the respective set of relevant signal components.

Thus, for instance, only those signal components of a set of the at least one set of signal components are selected which are sufficient to represent the respective part of the multi-channel signal at desired accuracy, whereas the remaining signal components may be discarded. These selected signal components may define the corresponding subset of relevant signal components. The number of selected components of a set of the at least one set of signal components of the second set of signal components may represent an extraction information associated with the respective set of the at least one set of signal components.

For instance, a measure of relevance may be determined for each signal component of each of the at least one set of signal components of the second set of signal components, the measure of relevance indicating the relevance of the associated signal component with respect to the part of multi-channel signal associated with the respective set of signal components of the second set of signal components.

As an example, the measure of relevance associated with a signal component may represent a variance. For instance, this variance may be computed by means of the respective component analysis when determining the second set of signal components, or when determining a subset of signal components of the second set of signal components, or when determining a subsubset of signal components of the first set of signal components.

For instance, $V_mv_{fb}(i)$ may represent the variance of the i-th signal component of a set of the at least one set of signal components of the second set of signal components, the set of the at least one set being associated with at least two channels of the at least two channels and with subband fb. Accordingly, for this example, a set of the at least one set represents a subsubset of signal components as mentioned above. As a non-limiting example, it may be assumed that the set of the at least one set of signal components of the second set of signal components is associated with all M channels of the at least two channels of the multi-channel signal. Furthermore, it may be assumed that variances $V_{m,fb}(i)$ have been sorted in decreasing order.

Then, the subset of relevant components of the respective set of the at least one set of signal components may be extracted based on the following pseudo-code:

```
aSum = 0
tSum = Σ_{i=0}^{length(V_mv_fb)-1} V_mv_fb(i)
for i = 0 to length (V_mv_fb) - 1
  aSum = aSum + V_mv_fb(i);

  if aSum / tSum > thr_ind2
    exit for loop
  End
End
vIdx_mv_fb = i
```

Thus, this example of a code may determine how many signal components of the set of the at least one set of signal components of the second set of signal components are needed such that the accumulated variance divided by the sum of all variances exceeds the second accuracy criteria thr_ind2. For instance, this second accuracy criteria thr_ind2 may be set to 0.9995, but any other well-suited threshold may also be used. This second accuracy criteria may indicate that signal components with large associated variances represent significant dynamics in the audio/video scene, while those with lower variances represent less detailed information and can be discarded. Accordingly, only the signal components of the set of the at least one set of signal components being associated with the $vIdx_mv_{fb}$ highest variances are selected for the respective subset of relevant signal components of the second set of signal components.

For instance, in the set of second signal components at least one set of the at least one set of signal components of the second set of signal components may be replaced by the respective at least one subset of relevant signal components.

The second embodiment of an extracting method depicted in FIG. 7*b* may be performed after the second component analysis is performed. With respect to the flowchart depicted in FIG. 2, the second embodiment of an extracting method depicted in FIG. 7*b* may be placed after applying the second component analysis.

Then, for instance, applying the second component analysis may be based on the at least one extracted subset of relevant signal components of the first set of signal components.

For instance, the down-sampled representation of the multi-channel signal may comprise the at least one extracted subset of relevant signal components of the second set of signal components.

Accordingly, a further data rate reduction may be performed based on the first and/or second embodiment of an extracting method.

Figure 8:
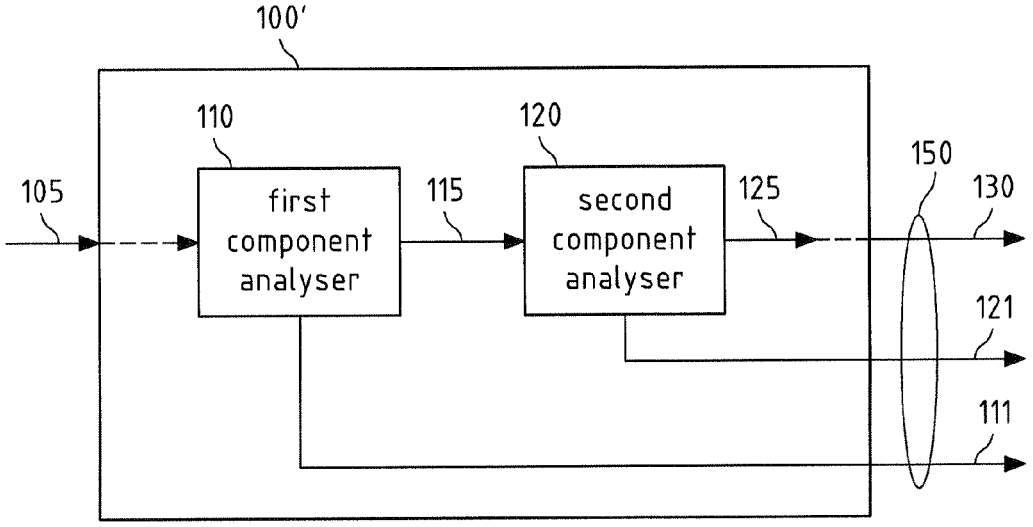
FIG. 8 is a schematic block diagram which illustrates a third embodiment of an apparatus.

FIG. 8 depicts a schematic block diagram which illustrates a third embodiment of an apparatus 100'. This third embodiment of an apparatus 100' is based on the first embodiment of an apparatus 100. Accordingly, the explanations presented with the respect to first embodiment of an apparatus 100 also hold for the third embodiment of an apparatus 100', and the explanations given with respect to the third embodiment of an apparatus 100' may also hold for the second embodiment of an apparatus 600 depicted in FIG. 6*a*.

The third apparatus 100' is configured to output a signal scene information 150 which comprises the down-sampled representation 130 of the multi-channel signal, a first set of analysis components 111 associated with the first component analysis, and a second set of analysis components 121 associated with the second component analysis.

The first set of analysis components may represent the first set of analysis components as mentioned above and is configured to be used in combination with the first set of signal components for reconstruction of the multi-channel signal.

The second set of analysis components may represent the second set of analysis components as mentioned above and is configured to be used in combination with the second set of signal components for reconstruction of the first set of signal components.

Furthermore, for instance, the signal scene information 150 may comprise the first and/or second extraction information.

Figure 12:
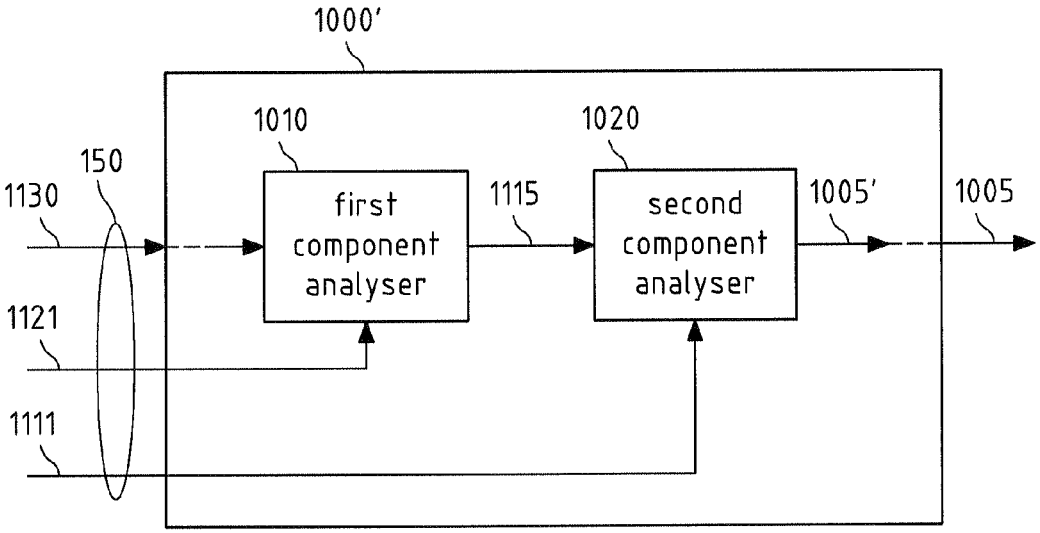
FIG. 12 is a schematic block diagram which illustrates a sixth embodiment of an apparatus.

FIG. 12 depicts a schematic block diagram which illustrates a sixth embodiment of an apparatus 1000'. This sixth embodiment of an apparatus 1000' is based on the fourth embodiment of an apparatus 1000. Accordingly, the explanations presented with the respect to fourth embodiment of an apparatus 1000 also hold for the sixth embodiment of an apparatus 1000', and the explanations given with respect to the sixth embodiment of an apparatus 1000' may also hold for the fifth embodiment of an apparatus 1600 depicted in FIG. 11.

The fifth apparatus 1000' may be configured to have access to signal scene information 150, the signal scene information which comprises the down-sampled representation 1130 of the multi-channel signal, the first set of analysis components 1111 associated with the second component synthesis, wherein the first set of analysis components 1111 is configured to be used in combination with the first set of reconstructed signal components 1115 for reconstruction of the multi-channel signal, and the second set of analysis components 1121 associated with the first component synthesis, wherein the second set of analysis components 1121 is configured to be used in combination with the down-sampled representation 1130 of the multi-channel signal for reconstruction of the second set of signal components.

For instance, it has to be understood that a corresponding apparatus for reconstructing the down-sampled multi-channel signal, for instance implemented by one of the fourth, fifth and sixth embodiment of an apparatuses, also falls within in the scope of the protection. As an example, this corresponding apparatus may represent a kind of receiver.

In the sequel a further embodiment of a method will be explained. In this further embodiment of a method both the first component analysis and the second component analysis are based on a PCA.

Furthermore, for instance, it is assumed that the first component analyser 110 performs an intra-channel component analysis and that the second component analyser 120 performs an inter-channel component analysis.

For instance, it is assumed that the at least two channels are M channels, and that the frequency domain representation 625 of the multi-channel signal is represented by $X_m[k,l]$ with $0<m\leq M$, as exemplarily explained with respect to the converter 140'.

As an example, the intra-channel PCA may decorrelate the channels of the multi-channel signal and determines the set of first signal components according to following steps:

Step 1:

$$[PC_{m,fb}, V_{m,fb}] = pca(Z_{m,fb}) \tag{7}$$

$$Z_{m,fb} = \begin{bmatrix} Y_m[\text{fb_start}(fb), 0] & \dots & Y_m[\text{fb_start}(fb), \text{TF_size}-1] \\ \vdots & \dots & \vdots \\ Y_m[\text{fb_end}(fb)-1, 0] & \dots & Y_m[\text{fb_end}(fb)-1, \text{TF_size}-1] \end{bmatrix}$$

$$\text{fb_start} = 0,\ fWidth,\ 2\cdot fWidth,\ 3\cdot fWidth,\ \dots\ ,\ A$$

$$\text{fb_end}(fb) = \text{fb_start}(fb+1) - \text{fb_start}(fb),\ 0 \leq fb < \text{length}(\text{fb_start})$$

where length( ) returns the length of the specified input vector and pca( ) is a function that returns the principal components $PC_{m,fb}$ associated variances $V_{m,fb}$ for the given input signal. The principal components $PC_{m,fb}$ may represent a subsubset of first analysis components of the set of first analysis components as mentioned above, wherein this subsubset of first analysis components is associated with subband fb and with channel m. In the end of this specification a detailed pseudo-code listing for the pca( ) function in simplified Matlab code and a mathematical formulation of PCA will be presented.

The size of matrix $Z_m$ is fSize×TF_size where fSize=fb_end(fb)−fb_start(fb). Furthermore, the dimensions of $PC_{m,fb}$ and $V_{m,fb}$ are fSize×fSize and fSize×1, respectively. Thus, the intra-channel PCA is determined on a subband fb where the width of the subband (fWidth) can either be fixed or variable.

For instance, as a non-limiting example, the width of a subband may be set to 6, i.e., 6 successive frequency components (e.g. frequency bins) of the m-th channel may represent a subset of time-frequency representatives of the m-th set of time-frequency representatives. As another example, for instance, the width of a subband may be variable. For example, the width of a subband may follow the boundaries of Equivalent Rectangular Bandwidth (ERB).

Step 2: The matrix $Z_{m,fb}$ may now projected using the principal components to obtain the decorrelated signal components according to $$D_{m,fb} = PC_{m,fb}^{T} \cdot Z_m, \tag{8}$$

where $D_{m,fb}$ represents the determined subsubset of signal components of the first set of signal components associated with subband fb and with channel m.

Next, the subset of relevant components of the subsubset of signal components most relevant decorrelated signal components may be extracted from $D_m$ according to following pseudo-code and as explained with respect to the first embodiment of an extracting method:

```
aSum = 0
tSum = Σ_{i=0}^{length(V_{m,fb})-1} V_{m,fb}(i)
for i = 0 to length (V_{m,fb}) - 1
  aSum = aSum + V_{m,fb}(i);

  if aSum / tSum > thr_ind
    exit for loop
```

-continued

```
        End
    End
    vIdx_{m,fb} = i
```

Thus, the above pseudo-code may determine how many principal components are needed such that the accumulated variance divided by the sum of all variances exceeds the example threshold thr_ind. For instance, this threshold value may be set to 0.9995. This value may indicate that principal components with large associated variances represent significant dynamics in the signal, while those with lower variances represent noise and can be discarded.

Thus, the intra-channel PCA of step 1 and step 2 may correspond to the component analysis applied for a respective subband (fb) of a respective channel (m) for determining a subsubset of signal components ($D_{m,fb}$) as indicated by reference sign 430 in FIG. 4*b* and explained with respect to the embodiment of a method depicted in FIG. 4*b*. The intra-channel PCA and the first embodiment of an extracting may be performed for each subband of each of the M channels; for instance by means of the loops depicted in FIG. 4*b* or by means of the embodiment of a method depicted in FIG. 4*a*.

For instance, the inter-channel PCA may analyse the correlations across channels of the multi-channel signal, and thereby decorrelate the channels of the multi-channel signal and extracts the most relevant signal components according to following:

$$[\mathrm{PC_mv}_{fb}, \mathrm{V_mv}_{fb}] = pca(W_{fb}) \tag{9}$$

$$W_{fb} = \begin{bmatrix} D_0[0,0] & & D_0[0,\mathrm{TF_size}-1] \\ D_0[1,0] & & D_0[1,\mathrm{TF_size}-1] \\ \vdots & & \vdots \\ D_0[vIdx_{0,fb}-1,0] & \dots & D_0[vIdx_{0,fb}-1,\mathrm{TF_size}-1] \\ \vdots & & \vdots \\ D_{M-1}[0,0] & & D_{M-1}[0,\mathrm{TF_size}-1] \\ \vdots & & \vdots \\ D_{M-1}[vIdx_{M-1,fb}-1,0] & & D_{M-1}[vIdx_{M-1,fb}-1,\mathrm{TF_size}-1] \end{bmatrix}$$

where M is the number of channels of the multi-channel signal. The size of matrix $W_{fb}$ is P×TF_size, where $$P = \sum_{i=0}^{M-1} vIdx_{m,fb}.$$

The principal components $\mathrm{PC_mv}_{fb}$ may represent a subset of second analysis components of the set of second analysis components, wherein this subset of second analysis components is associated with subband fb and with all M channels.

The matrix $W_{fb}$ may now projected using the principal components to obtain the decorrelated signal components corresponding to the channels of the input signal according to $$R_{fb} = \mathrm{PC}_mv_{fb}^{T} \cdot W, \tag{10}$$

where $R_{fb}$ the determined subset of signal components of the second set of signal components being associated with subband fb and with all M channels.

Accordingly, the inter-channel PCA may corresponds to the component analysis for determining a subset of signal components $R_{fb}$ of the second set of signal components indicated by reference sign 540 depicted in FIG. 5*b*, wherein the loop for selecting the channels is discarded and selected at least two channels represent the M channels.

The, for instance, the most relevant decorrelated signal components of the channels of the input signal may be extracted from $R_{fb}$ according to above-mentioned example of second extracting method:

```
aSum = 0
tSum = Σ_{i=0}^{length(V_mv_fb)-1} V_mv_fb(i)
for i = 0 to length (V_mv_fb) - 1
  aSum = aSum + V_mv_fb(i);

  if aSum / tSum > thr_ind2
    exit for loop
  End
End
vIdx_mv_fb = i
```

Thus, the above pseudo-code may determine how many principal components are needed such that the accumulated variance divided by the sum of all variances exceeds the threshold thr_ind2. For instance, this threshold value may be set to 0.9999. This value may indicates that principal components with large associated variances represent significant dynamics in the audio scene, while those with lower variances represent less detailed information and can be discarded.

For instance, the down-sampled representation for each subband fb of the plurality of subbands of the multi-channel signal be obtained as follows $$S_{fb} = \lfloor R_{fb}[0,1{:}\mathrm{TF_size}], \dots R_{fb}\lfloor vIdx_mv_{fb}, 1{:}\mathrm{TF_size} \rfloor\rfloor \tag{11}$$

Furthermore, for instance, the signal scene information may be represented by the following elements for each subband fb of the plurality of subbands:

$$\mathrm{PC}_{0,fb}, \dots, \mathrm{PC}_{M-1,fb}, \mathrm{PC}_mv_{fb}$$

$$vIdx_{0,fb}, \dots, vIdx_{M-1,fb}, vIdx_mv_{fb}$$

Vector $S_{fb}$

Thus, for instance, the multi-channel signal scene may be represented by M sets of intra-PCA components (representing the first set of analysis information) together with the information regarding the number of intra-PCA components (representing the first extraction information) included in respective set, a set of inter-PCA components (second set of analysis information) together with the information regarding the number of intra-PCA components (representing the second extraction information), and a down sampled signal representation of the multi-channel signal.

For instance, any of the above mentioned embodiment of a method and/or embodiment of an apparatus may be applied to a transmitter configured to transmit the down-sampled representation of the multi-channel signal or the signal scene information.

For instance, at the reconstruction side, i.e. by one of the fourth, fifth or sixth embodiments of an apparatus, the reverse of the operations are performed.

First, as an example, the inter PCA synthesis may be applied to recover the individual decorrelated signals on each of the channels as following step:

Step 3:

$$\hat{W}_{fb}=\text{PC_}m\hat{v}_{fb}\cdot\hat{R}_{fb} \tag{12}$$

where PC_m$\hat{v}_{fb}$ contains the accessed principal components of the respective subband fb (as part of the second set of analysis information) for the decorrelated multi-channel signal, i.e. PC_m$\hat{v}_{fb}$ may represent an accessed subset of second analysis components of the set of second analysis components. Furthermore, $$\hat{R}_{fb}=\begin{bmatrix} \hat{S}_{fb}[0,0] & \dots & \hat{S}_{fb}[0,\text{TF_size}-1] \\ \vdots & \dots & \vdots \\ \hat{S}_{fb}[\text{vIdx_mv}_{fb}-1,0] & \dots & \hat{S}_{fb}[\text{vIdx_mv}_{fb}-1,\text{TF_size}-1] \\ 0_{MV-\text{vIdx_mv}_{fb},1} & \dots & 0_{MV-\text{vIdx_mv}_{fb},1} \end{bmatrix} \tag{13}$$

$$MV=\sum_{i=0}^{M-1} vIdx_{m,fb}$$

where $\hat{S}_{fb}$ contains the accessed down sampled signal representation of the multi-channel signal and $0_{x,y}$, represents a zero valued matrix with x rows and y columns, which may be determined based on the accessed second extraction information.

Next, for instance, the intra PCA synthesis may be applied to recover the signals on each of the channels for the 2D time-frequency plane as following step:

Step 4:

$$\hat{Z}_m[\text{fb_start}(fb):\text{fb_end}(fb)-1,1:\text{TF_size}-1]=P\hat{C}_{m,fb}\cdot\hat{D}_{m,fb}$$

$$\hat{D}_{m,fb}=\begin{bmatrix} \hat{W}[mOffset,0] & \dots & \hat{W}[mOffset,\text{TF_size}-1] \\ \vdots & \dots & \vdots \\ \hat{W}[mOffset+vIdx_m-1,0] & \dots & \hat{W}[mOffset+vIdx_m-1,\text{TF_size}-1] \\ 0_{fSize-vIdx_m,1} & \dots & 0_{fSize-vIdx_m,1} \end{bmatrix}$$

$$mOffset=\sum_{j=0}^{m-1} vIdx_j$$

where $P\hat{C}_{m,fb}$ contains the accessed principal components for the individual channels of the multi-channel signal, i.e. $P\hat{C}_{m,fb}$ may represent an accessed subsubset of first analysis components of the set of first analysis components. Steps 3 and 4 may be repeated for 0≤fb<length(fb_start) in the same manner as done in the analysis side, i.e. for each subband of the plurality of subbands.

The 2D time-frequency samples $\hat{Y}_m$ are transferred to frequency domain samples via 2D-IDCT according to $$\hat{X}_m=\hat{Y}_m^{-1} \tag{15}$$

$$\hat{Y}_m=\begin{bmatrix} \hat{Z}_m[0,0]^T, & \dots & \hat{Z}_m[0,\text{TF_size}-1]^T \\ \vdots & \dots & \vdots \\ \hat{Z}_m[A-1,0]^T & \dots & \hat{Z}_m[A-1,\text{TF_size}-1]^T \end{bmatrix}$$

Finally, the frequency domain samples may be transformed to time domain signals $\hat{x}_m$ via inverse TF, in this case via IMDCT as follows $$xx_m[k,l]=\frac{2}{N}\cdot w[k]\cdot\sum_{n=0}^{\frac{N}{2}-1}\hat{X}_m[n,l]\cdot\cos\left(\frac{2\cdot\pi}{N}\cdot\left(k+\frac{N}{4}+0.5\right)\cdot(n+0.5)\right),$$

$$0\le k<N-1$$

$$\hat{x}_m[k+l\cdot T]=xx_m[k,l]+xx_m\left[\frac{N}{2}+k,l-1\right],\ 0\le k<\frac{N}{2}$$

Thus, for instance, $\hat{x}_m$ may represent the reconstructed multi-channel signal 1005.

Now, as an example, the mathematical background of PCA will be explained. In general, the PCA analysis may be mathematically as follows:

Let the data set be X, an m x n matrix, where m is the number of measurement types and n is the number of samples. The goal is summarized as follows.

Find some orthonormal matrix P where Y=PX such that $$C_Y=\frac{1}{n-1}\cdot YY^T$$

is diagonalized. (14)

The rows of P are the principal components of X.

Begin by rewriting $C_Y$ in terms of our variable of choice P $$C_Y=\frac{1}{n-1}\cdot PAP^T \tag{16}$$

A new matrix $A\equiv XX^T$ has been defined where A is symmetric. Furthermore, $$A=EDE^T \tag{17}$$

where D is a diagonal matrix and E is a matrix of eigenvectors of A arranged as columns. Let the matrix P to be a matrix where each row $p_i$ is an eigenvector of $XX^T$. By this selection, $P\equiv E^T$. Substituting into Equation (17), we find $A=P^TDP$. With this relation and $P^{-1}=P^T$ we can finish evaluating $C_Y$ as follows $$C_Y=\frac{1}{n-1}\cdot D \tag{18}$$

It is evident that the choice of P diagonalizes $C_Y$. This was the goal for PCA. The results of PCA in the matrices P and $C_Y$ can be summarized as follows The principal components of X are the eigenvectors of $XX^T$; or the rows of P The $i^{th}$ diagonal value of $C_Y$ is the variance of x along $p_i$ In practice computing PCA of a data set x may entails (5) subtracting off the mean of each measurement type and (6) computing the eigenvectors of $XX^T$.

For instance, a PCA may be performed by the following example Matlab code for calculating the PCA of a signal:

```
function [PC,V]=pca(X)
% Perform PCA using covariance.
M=rows(X);
N=columns(X);
% subtract off the mean for each dimension
mn=mean(X,2);
data=X-repmat(mn,1,N);
% calculate the covariance matrix
covariance=1/(N-1)*X*X';
% find the eigenvectors and eigenvalues.
% produces a diagonal matrix V of eigenvalues and a full
  matrix PC whose columns are the corresponding eigen-
  vectors so that covariance *V=V*PC.
[PC, V]=eig(covariance);
% extract main diagonal of matrix V as vector
V=diag(V);
% sort the variances V in decreasing order
[junk, rindices]=sort(-1*V);
V=V(rindices);
% principal components
PC=PC(:,rindices);
```

Furthermore, it is readily clear for a person skilled in the art that the logical blocks in the schematic block diagrams as well as the flowchart and algorithm steps presented in the above description may at least partially be implemented in electronic hardware and/or computer software, wherein it may depend on the functionality of the logical block, flowchart step and algorithm step and on design constraints imposed on the respective devices to which degree a logical block, a flowchart step or algorithm step is implemented in hardware or software. The presented logical blocks, flowchart steps and algorithm steps may for instance be implemented in one or more digital signal processors (DSPs), application specific integrated circuits (ASICs), field programmable gate arrays (FPGAs) or other programmable devices. The computer software may be stored in a variety of computer-readable storage media of electric, magnetic, electro-magnetic or optic type and may be read and executed by a processor, such as for instance a microprocessor. To this end, the processor and the storage medium may be coupled to interchange information, or the storage medium may be included in the processor.

Any presented connection in the described embodiments is to be understood in a way that the involved components are operationally coupled. Thus, the connections can be direct or indirect with any number or combination of intervening elements, and there may be merely a functional relationship between the components.

Any of the processors mentioned in this text could be a processor of any suitable type. Any processor may comprise but is not limited to one or more microprocessors, one or more processor(s) with accompanying digital signal processor(s), one or more processor(s) without accompanying digital signal processor(s), one or more special-purpose computer chips, one or more field-programmable gate arrays (FPGAS), one or more controllers, one or more application-specific integrated circuits (ASICS), or one or more computer(s). The relevant structure/hardware has been programmed in such a way to carry out the described function.

Any of the memories mentioned in this text could be implemented as a single memory or as a combination of a plurality of distinct memories, and may comprise for example a read-only memory, a random access memory, a flash memory or a hard disc drive memory etc.

Moreover, any of the actions described or illustrated herein may be implemented using executable instructions in a general-purpose or special-purpose processor and stored on a computer-readable storage medium (e.g., disk, memory, or the like) to be executed by such a processor. References to 'computer-readable storage medium' should be understood to encompass specialized circuits such as FPGAs, ASICs, signal processing devices, and other devices.

It will be understood that all presented embodiments represent non-limiting examples, that features of these embodiments may be omitted or replaced and that other features may be added. Any mentioned element and any mentioned method step can be used in any combination with all other mentioned elements and all other mentioned method step, respectively. It is the intention, therefore, to be limited only as indicated by the scope of the claims appended hereto.

The invention claimed is:

1. A method comprising:

performing a concatenated component analysis based on a time-frequency representation of a multi-channel signal for determining a down-sampled representation of the multi-channel signal, the multi-channel signal being associated with at least two channels, wherein said concatenated component analysis comprises:

applying a first component analysis for determining a first set of signal components representing the multi-channel signal; and applying a second component analysis based on the first set of signal components for determining a second set of signal components representing the multi-channel signal, wherein the first component analysis comprises a first decorrelation of the time-frequency representation of the multi-channel signal and the second component analysis comprises a second decorrelation of the multi-channel signal based on the first set of signal components, the first decorrelation being one of intra-channel decorrelation, in which decorrelation is performed to decorrelate each channel of at least one channel of the at least two channels separately, and inter-channel decorrelation, in which decorrelation is performed between at least two channels of the at least two channels of the multi-channel signal, and the second decorrelation being the remaining one of inter-channel decorrelation and intra-channel decorrelation.

2. The method according to claim 1, the first component analysis comprising the intra-channel decorrelation and the second component analysis comprising the inter-channel decorrelation.

3. The method according to claim 2, wherein each channel of the at least one channel of the at least two channels is associated with a frequency band, and the intra-channel decorrelation for a respective channel comprises performing decorrelation for each subband of at least one subband of the frequency band of the respective channel for determining a subsubset of signal components associated with the respective subband of the respective channel for each subband of the at least one subband, a subsubset of signal components representing signal components of the first set of signal components representing the signal in the respective subband of the respective channel of the multi-channel signal.

4. The method according to claim 3, wherein the inter-channel decorrelation comprises performing at least one decorrelation for determining at least one subset of signal components of the second set of signal components, wherein each of the at least one decorrelation is associated with at least two channels of the at least two channels of the multi-channel signal and with a subband of a frequency band associated with the respective at least two channels of the at least two channels, each determined subset of signal components representing signal components of the second set of signal components representing the signals of the respective at least two channels of the multi-channel signal in the respective subband.

5. The method according to claim 1, comprising converting a time-domain representation of the multichannel signal to said time-frequency representation of the multi-channel signal, the time-frequency representation comprising at least two sets of time-frequency representatives, each set of the at least two sets of time-frequency representatives being associated with one channel of the at least two channels.

6. The method according to claim 5, said converting comprising for each of the at least two channels:

transforming the time-domain representation of the respective channel of the time-domain representation into a frequency domain representation; and performing a two-dimensional discrete cosine transformation based on the frequency domain representation associated with the respective channel in order to determine the set of time-frequency representatives associated with the respective channel.

7. The method according to claim 1, comprising at least one of:

extracting from each of at least one set of signal components of the first set of signal components a separate subset of relevant signal components, wherein each subset of relevant signal components represents a part of the multi-channel signal associated with the respective set of signal components of the first set of signal components in accordance with a first accuracy criteria; and extracting from each of at least one set of signal components of the second set of signal components a separate subset of relevant signal components, wherein each subset of relevant signal components represents a part of the multi-channel signal associated with the respective set of signal components of the second set of signal components in accordance with a second accuracy criteria.

8. The method according to claim 7, comprising at least one of:

performing the second decorrelation based on the at least one extracted subset of relevant signal components of the first set of signal components; and the down-sampled representation of the multi-channel signal comprises the at least one extracted subset of relevant signal components of the second set of signal components.

9. The method according to claim 1, comprising determining signal scene information, the signal scene information comprising:

the down-sampled representation of the multi-channel signal;

a first set of analysis components associated with the first component analysis, wherein the first set of analysis components is configured to be used in combination with the first set of signal components for reconstruction of the multi-channel signal; and a second set of analysis components associated with the second component analysis, wherein the second set of analysis components is configured to be used in combination with the second set of signal components for reconstruction of the first set of signal components.

10. An apparatus comprising at least one processor and at least one memory including computer program code, the at least one memory and the computer program code, with the at least one processor, configured to cause the apparatus at least to perform:

perform a concatenated component analysis based on a time-frequency representation of a multi-channel signal for determining a down-sampled representation of the multi-channel signal, the multi-channel signal being associated with at least two channels, wherein said concatenated component analysis comprises:

apply a first component analysis for determining a first set of signal components representing the multi-channel signal; and apply a second component analysis based on the first set of signal components for determining a second set of signal components representing the multi-channel signal, wherein the first component analysis comprises a first decorrelation of the time-frequency representation of the multi-channel signal and the second component analysis comprises a second decorrelation of the multi-channel signal based on the first set of signal components, the first decorrelation being one of intra-channel decorrelation, in which decorrelation is performed to decorrelate each channel of at least one channel of the at least two channels separately, and inter-channel decorrelation, in which decorrelation is performed between at least two channels of the at least two channels of the multi-channel signal, and the second decorrelation being the remaining one of inter-channel decorrelation and intra-channel decorrelation.

11. The apparatus according to claim 10, the first component analysis comprising the intra-channel decorrelation and the second component analysis comprising the inter-channel decorrelation.

12. The apparatus according to claim 10, wherein the apparatus is one of:

a chip;

an integrated circuit;

an audio device; and a video device.

* * * * *